US008441177B2

(12) United States Patent
Kameda

(10) Patent No.: US 8,441,177 B2
(45) Date of Patent: May 14, 2013

(54) PLASMA JET IGNITION PLUG

(75) Inventor: Hiroyuki Kameda, Aichi-ken (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/404,055

(22) Filed: Feb. 24, 2012

(65) Prior Publication Data

US 2012/0242214 A1 Sep. 27, 2012

(30) Foreign Application Priority Data

Feb. 25, 2011 (JP) ..... 2011-39441
Jan. 11, 2012 (JP) ..... 2012-2702

(51) Int. Cl.
*H01T 13/20* (2006.01)

(52) U.S. Cl.
USPC ..... 313/143; 313/141

(58) Field of Classification Search ..... 313/118, 313/130, 141, 143
See application file for complete search history.

(56) References Cited

U.S. PATENT DOCUMENTS

| | | | | |
|---|---|---|---|---|
| 4,795,937 | A | 1/1989 | Wagner et al. | 313/130 |
| 7,772,752 | B2 | 8/2010 | Nakamura et al. | 313/141 |
| 7,816,846 | B2 * | 10/2010 | Takada et al. | 313/143 |

FOREIGN PATENT DOCUMENTS

| | | |
|---|---|---|
| JP | 62-145678 | 6/1987 |
| JP | 2006-244867 | 9/2006 |
| JP | 2009-176691 | 8/2009 |

* cited by examiner

*Primary Examiner* — Vip Patel
(74) *Attorney, Agent, or Firm* — Kusner & Jaffe

(57) ABSTRACT

A plasma jet ignition plug including an insulating body having an axial hole therethrough. A center electrode is inserted into the axial hole. A cavity portion is defined by the insulating body and center electrode, with the leading end of the axial hole as an opening end. A decreasing diameter portion decreasing in diameter toward a leading end side is formed on the axial hole, the leading end of the decreasing diameter portion is positioned closer to the leading end side than the leading end face of the center electrode. The inside diameter of the leading end of the decreasing diameter portion is made smaller than the outside diameter of the leading end face of the center electrode.

7 Claims, 24 Drawing Sheets

PLASMA JET IGNITION PLUG

FIELD OF THE INVENTION

The present invention relates to a plasma jet ignition plug which carries out an ignition of a mixture by generating plasma.

BACKGROUND OF THE INVENTION

Heretofore, an ignition plug which ignites a mixture using a spark discharge has been used in a combustion device such as an internal combustion engine. Also, in recent years, in order to comply with a demand for higher power and lower fuel consumption in the combustion device, a plasma jet ignition plug has been proposed as an ignition plug with which it is also possible to more reliably ignite a lean mixture with a fast-spreading combustion and a higher ignition limit air/fuel ratio.

In general, a plasma jet ignition plug includes a hollow cylindrical insulating body having an axial hole, a center electrode inserted into the axial hole in a condition in which the leading end face of the center electrode is withdrawn below the leading end face of the insulating body. A metal shell is disposed on the outer periphery of the insulating body, and an annular ground electrode is joined to a leading end portion of the metal shell. Also, the plasma jet ignition plug has a space (a cavity portion) surrounded by the center electrode and axial hole. The cavity portion is caused to communicate with the exterior via a through hole formed in the ground electrode.

With this kind of plasma jet ignition plug, an ignition of a mixture is carried out in the following way. Firstly, a voltage is applied between the center electrode and ground electrode, causing a spark discharge between the two, thus causing insulation breakdown between the two. After that, a discharge condition is shifted by causing high-energy current to flow between the two, generating plasma inside the cavity portion. Then, the generated plasma is emitted from an opening of the cavity portion, thereby carrying out an ignition of a mixture.

Meanwhile, as a technique of realizing still more superior ignitability, it is conceivable that, by causing a spark discharge in a path passing through the air (an aerial discharge path), plasma is generated in a condition in which there is nothing around to suppress a spreading, thus improving the efficiency of generation of plasma. Specifically, it is conceivable to adopt a configuration such that the ground electrode is spaced apart from the leading end face of the insulating body, thereby allowing a spark discharge to occur along a creeping discharge path creeping along the inner peripheral surface of the insulating body, between the leading end face of the center electrode and the leading end of the axial hole, and an aerial discharge path passing through the air, between the leading end of the axial hole and the ground electrode (for example, Japanese Patent Document JP-A-2009-176691).

However, with the heretofore described technique, as the aerial discharge path is formed closer to a leading end side than the cavity portion, plasma generation in the aerial discharge path occurs in a condition in which there is a large space on an outer circumference side. Consequently, there is a danger that plasma expands to the outer circumference side, and the pressure and temperature of the plasma drop due to energy being consumed in the expansion. As a result of this, the length of emission of plasma from the opening of the cavity portion decreases, and there is a danger that it is not possible to sufficiently improve ignitability.

The invention, having been contrived bearing in mind the heretofore circumstances, has an object of providing a plasma jet ignition plug with which it is possible to dramatically improve ignitability by suppressing an expansion of plasma generated in an aerial discharge path, or the like.

SUMMARY OF THE INVENTION

Hereafter, an itemized description will be given of each configuration suitable for achieving the aforementioned object. Working effects specific to the corresponding configurations are quoted as necessary.

Configuration 1. In this configuration, a plasma jet ignition plug is characterized by including:

an insulating body having an axial hole extending in a direction of an axis;

a center electrode inserted into the axial hole in such a way that the leading end face of the center electrode is positioned closer to a rear end side in the axis direction than the leading end of the insulating body;

a metal shell disposed on the outer periphery of the insulating body; and a ground electrode, fixed to a leading end portion of the metal shell, which is disposed closer to a leading end side in the axis direction than the leading end of the insulating body, and including:

a cavity portion formed by being surrounded by the insulating body and center electrode with the leading end of the axial hole as an opening end, wherein a decreasing diameter portion decreasing in diameter toward the axis direction leading end side is formed on the axial hole, the leading end of the decreasing diameter portion is positioned closer to the axis direction leading end side than the leading end face of the center electrode, and the inside diameter of the leading end of the decreasing diameter portion is made smaller than the outside diameter of the leading end face of the center electrode, and when a shortest distance between the leading end face of the center electrode and a region on the decreasing diameter portion opposed in the axis direction to the leading end face of the center electrode is taken to be A (mm), while a point on the decreasing diameter portion inner peripheral surface, which forms the shortest distance A, is taken to be "a," and a shortest distance in a direction perpendicular to the axis, between the outer circumference of the leading end face of the center electrode and the inner peripheral surface of the axial hole, is taken to be B (mm), $A \leqq B$ is satisfied.

According to the configuration 1, at least an outer circumference side region of the center electrode leading end face is opposed in the axis direction to the decreasing diameter portion formed on the axial hole, and the shortest distance A between the leading end face of the center electrode and the decreasing diameter portion is made smaller than the shortest distance B between the leading end face of the center electrode and an inner peripheral surface of the axial hole positioned circumferentially to the leading end face of the center electrode. That is, a configuration is adopted such that an aerial discharge occurs in a direction approximately parallel to the axis, between the leading end face of the center electrode and the decreasing diameter portion, when a spark discharge is caused, and such that the inner peripheral surface of the axial hole is positioned around this aerial discharge path, and the decreasing diameter portion is positioned around at least the leading end side of the aerial discharge path.

Consequently, plasma generation in the aerial discharge path occurs down inside the cavity portion in a condition in which the inner peripheral surface of the axial hole exists on the outer circumference side. Because of this, it is possible to suppress an expansion of plasma to the outer circumference side, and it is possible to generate higher-temperature and higher-pressure plasma.

In addition, as the existence of the decreasing diameter portion makes it difficult for plasma in the aerial discharge path to leak out to the opening side of the cavity portion during plasma generation, it is possible to generate still higher-temperature and higher-pressure plasma.

Moreover, by $A \leqq B$ being set to allow an aerial discharge and thus plasma to be generated in a direction approximately parallel to the axis, it is possible to smoothly emit plasma from the opening of the cavity portion.

As above, according to the configuration 1, by the heretofore described individual working effects acting synergistically, it is possible to very effectively increase the length of emission of plasma from the opening of the cavity portion. As a result of this, it is possible to achieve a dramatic improvement in ignitability.

Configuration 2. In this configuration, the plasma jet ignition plug according to the configuration 1 is characterized in that when the degree of an acute angle among the angles formed by the visible outline of the decreasing diameter portion and a straight line perpendicular to the axis, on a section including the axis, is taken to be $\alpha°$, $10 \leqq \alpha \leqq 35$ is satisfied.

When the visible outline of the decreasing diameter portion forms a bent shape or curved shape, the angle $\alpha$ refers to the degree of an acute angle among the angles formed by a straight line connecting the leading end and rear end of the visible outline of the decreasing diameter portion and a straight line perpendicular to the axis.

According to the configuration 2, as the angle $\alpha$ is set to 35° or less, it is possible to more reliably suppress an instantaneous diffusion in the axis direction of plasma generated in the aerial discharge path. Consequently, it is possible to generate still higher-pressure plasma in a space on the inner peripheral side of the decreasing diameter portion. As a result of this, it is possible to further increase the length of emission of plasma from the opening of the cavity portion, and it is possible to further improve ignitability.

Also, as the angle $\alpha$ is set to 10° or more, it is possible to more reliably prevent plasma generated in the aerial discharge path from flowing into a space between the outer peripheral surface of the leading end portion of the center electrode and the inner peripheral surface of the axial hole. As a result of this, it is possible to further increase the force of emission of plasma toward the opening side of the cavity portion, and it is possible to still further improve ignitability.

Configuration 3. In this configuration, the plasma jet ignition plug according to the configuration 1 or 2 is characterized in that the cavity portion is formed into a shape wherein the inside diameter decreases gradually from the rear end of the cavity portion toward the axis direction leading end side, or a shape wherein the cavity portion has a region whose inside diameter decreases gradually from the rear end of the cavity portion toward the axis direction leading end side and a region whose inside diameter is constant.

According to the configuration 3, the cavity portion is configured having no region whose inside diameter increases toward the axis direction leading end side. Consequently, it is possible to more reliably suppress an expansion of plasma to the outer circumference side and a diffusion of plasma when emitted from the opening of the cavity portion. As a result of this, it is possible to further increase the length of emission of plasma, and it is possible to achieve a further improvement in ignitability.

Configuration 4. In this configuration, the plasma jet ignition plug according to any one of the configurations 1 to 3 is characterized in that when the volume of a first cavity portion of the cavity portion bounded by a virtual plane including the leading end face of the center electrode, a virtual plane, including the point "a," perpendicular to the axis direction, and the inner peripheral surface of the axial hole is taken to be V1 ($mm^3$), and the volume of a second cavity portion of the cavity portion bounded by the virtual plane including the leading end face of the center electrode, the outer peripheral surface of the center electrode, and the inner peripheral surface of the axial hole is taken to be V2 ($mm^3$), $V2 \leqq V1 \times 5$ is satisfied.

When the volume V2 of the second cavity portion is made excessively larger than the volume V1 of the first cavity portion, there is a danger that the second cavity portion cannot be sufficiently filled with plasma generated in the aerial discharge path (in the first cavity portion), as a result of which the force of emission of plasma decreases.

In this regard, according to the configuration 4, as a configuration is adopted such that $V2 \leqq V1 \times 5$ is satisfied, a configuration is adopted such as to prevent the volume V2 of the second cavity portion from becoming excessively larger than the volume V1 of the first cavity portion. Consequently, it is possible to sufficiently fill the second cavity portion with plasma generated in the aerial discharge path (first cavity portion), and it is possible to emit plasma toward the leading end side with a high pressure. As a result of this, it is possible to further improve ignitability.

Configuration 5. In this configuration, the plasma jet ignition plug according to any one of the configurations 1 to 4 is characterized in that a straight portion, having approximately the same inside diameter, which extends from the leading end of the decreasing diameter portion to the opening of the cavity portion is formed on the axial hole, and a length of the straight portion along the axis is set to 0.3 mm or more.

When the outermost leading end portion of the axial hole is formed into a shape wherein the inside diameter decreases toward the leading end side, or when a straight portion is provided on the outermost leading end portion of the axial hole, but the length thereof is extremely short, a region with a comparatively small thickness in the axis direction is formed on the leading end side inner periphery of the insulating body. Herein, in general, there occurs a phenomenon (a so-called channeling) wherein the surface of the insulating body is cut as a result of a spark discharge, while the heretofore described kind of thin region is cut deeper outward in a radial direction when a spark discharge occurs. In a region cut deep, the length of the spark discharge path between the center electrode and ground electrode is shorter than the length of another path along the inner peripheral surface of the insulating body, so there is a danger that a spark discharge occurs concentrated in the region cut deep, as a result of which a streaky deep groove is formed in the inner peripheral surface of the insulating body in a short period. On this kind of groove being formed, a spark discharge occurs, along the deep groove, between the insulating body side surface of the ground electrode and the center electrode, and there is a danger that the existence of the ground electrode makes it difficult for plasma to be emitted.

In this regard, according to the configuration 5, the straight portion is provided on the outermost leading end portion of the axial hole, and the length of the straight portion along the axis is set to 0.3 mm or more. That is, the thickness in the axis direction of a region of the insulating body positioned on the leading end side inner periphery is made sufficiently large. Consequently, it is possible to prevent the inner peripheral surface of the insulating body from being locally cut deep, and it is possible to cause a channeling approximately evenly in a circumferential direction. As a result of this, it is possible to more reliably prevent a rapid decrease in ignitability, and it is possible to maintain the superior ignitability according to the configuration 1, and the like, over a long period.

Configuration 6. In this configuration, the plasma jet ignition plug according to any one of the configurations 1 to 5 is characterized in that $0.05 \leqq A$ is satisfied, and the leading end face of the insulating body and the insulating body side surface of the ground electrode are in contact, and when a shortest distance along the insulating body inner peripheral surface between the point "a" and ground electrode is taken to be C (mm), $A+(C\times0.5) \leqq 1.50$ and $A \leqq 0.5$ are satisfied.

According to the configuration 6, as the ground electrode is in contact with the leading end face of the insulating body, it is possible to efficiently transfer the heat of the ground electrode to the metal shell side via the insulating body. Because of this, it is possible to improve the wear resistance of the ground electrode.

Also, according to the configuration 6, as the shortest distance A is set to 0.05 mm or more, a configuration is adopted such that the aerial discharge path has a sufficient length. Consequently, it is possible to further enhance the effectiveness of an improvement in ignitability owing to plasma being generated in the aerial discharge path.

The larger the shortest distance A, the more it is possible to hope for an improvement in plasma generation efficiency, but on the shortest distance A and the shortest distance C corresponding to the length of the creeping discharge path being excessively increased, a discharge voltage at an initial stage (before wear of the center electrode or the like) increases. It is desirable to keep the initial discharge voltage comparatively low (at 20 kV or less), considering that a discharge voltage increases gradually due to wear of the center electrode, and that the higher the discharge voltage, the more liable a channeling is to occur in the insulating body.

In this regard, according to the configuration 6, a configuration is adopted such that $A+(C\times0.5) \leqq 1.50$ and $A \leqq 0.5$ are satisfied. Consequently, it is possible to keep the initial discharge voltage comparatively low, and it is possible to more effectively suppress a discharge anomaly (a misfire), or a progress of a channeling, induced by an increase in discharge voltage.

The shortest distance C is multiplied by 0.5 in the heretofore mentioned expression because, when the discharge distances are made the same, a creeping discharge occurs at approximately half the voltage of an aerial discharge.

Configuration 7. In this configuration, the plasma jet ignition plug according to any one of the configurations 1 to 6 is characterized in that the center electrode includes:

a main body portion having, at its leading end, an outside diameter the same as the inside diameter of the axial hole; and a protruding portion, formed adjoining to the main body portion and closer to the axis direction leading end side than the main body portion, the outside diameter of the leading end of which is made smaller than the outside diameter of the leading end of the main body portion, wherein when a shortest distance along the insulating body inner peripheral surface between the point "a" and main body portion is taken to be D(mm), $A\times2 \leqq D$ is satisfied.

The "outside diameter of the main body portion being the same as the inside diameter of the axial hole" includes not only a case in which the outside diameter of the main body portion and the inside diameter of the axial hole are exactly the same, but also a case in which there is a slight difference (for example, on the order of 0.05 mm) between the outside diameter of the main body portion and the inside diameter of the axial hole.

According to the configuration 7, as the main body portion is formed larger in diameter than the protruding portion on the rear end side of the protruding portion, it is possible to efficiently transfer the heat of the protruding portion to the metal shell side via the main body portion. Consequently, it is possible to suppress wear of the center electrode leading end portion (protruding portion) induced by a spark discharge or the like, and it is possible to more reliably prevent a rapid increase in discharge voltage. As a result of this, it is possible to prevent an occurrence of a discharge anomaly (a misfire) or a progress of a channeling over a long period, and it is thus possible to maintain superior ignitability for a longer period.

Meanwhile, on the main body portion being provided, there is concern that a creeping discharge along the inner peripheral surface of the insulating body becomes liable to occur between the main body portion and ground electrode, and it becomes difficult for an aerial discharge to occur between the leading end face of the center electrode and the decreasing diameter portion.

In this regard, according to the configuration 7, as a configuration is adopted such that the shortest distances A and D satisfy $A\times2 \leqq D$, a configuration is adopted such that a discharge voltage needed for an aerial discharge between the point "a" and the leading end face of the center electrode is equal to or lower than a discharge voltage needed for a creeping discharge between the point "a" and the main body portion. Consequently, it is possible to more reliably cause an aerial discharge between the leading end face of the center electrode and the decreasing diameter portion, and it is possible to still more reliably achieve the working effects according to the configuration 1 and the like.

BRIEF DESCRIPTION OF THE DRAWINGS

FIG. 3 is a partially enlarged sectional view showing a positional relationship between a center electrode and a decreasing diameter portion, or the like.

DETAILED DESCRIPTION OF PREFERRED EMBODIMENTS

Figure 1:
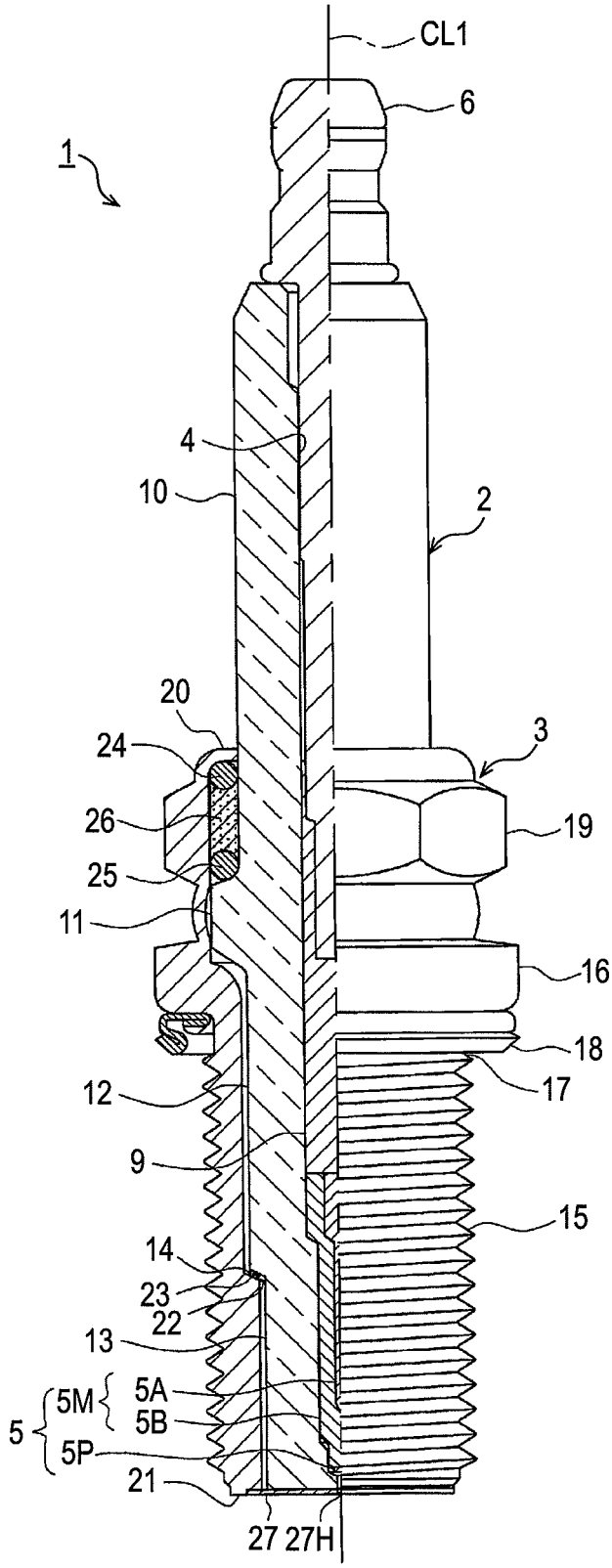
FIG. 1 is a partially sectioned front view showing a configuration of an ignition plug.

Hereafter, a description will be given of one embodiment, while referring to the drawings. FIG. 1 is a partially sectioned front view showing a plasma jet ignition plug (hereafter called an "ignition plug") 1. In FIG. 1, a description will be given with a direction of an axis CL1 of the ignition plug 1 as an up-down direction in the drawing, the lower side as the leading end side of the ignition plug 1, and the upper side as the rear end side.

The ignition plug 1 is configured of a hollow cylindrical insulator 2 acting as an insulating body, a hollow cylindrical metal shell 3 which holds the insulator 2, and the like.

The insulator 2, being formed by sintering alumina or the like, as is well known, includes in the external portion thereof a rear end side barrel portion 10 formed on the rear end side, a large diameter portion 11 formed closer to the leading end side than the rear end side barrel portion 10 so as to protrude outward in a radial direction, a middle barrel portion 12 formed closer to the leading end side than the large diameter portion 11 so as to be smaller in diameter than the large diameter portion 11, and an insulator nose length portion 13 formed closer to the leading end side than the middle barrel portion 12 so as to be smaller in diameter than the middle barrel portion 12. In addition, the large diameter portion 11, middle barrel portion 12, and insulator nose length portion 13 of the insulator 2 are housed inside the metal shell 3. Accordingly, a shoulder 14 is formed at the junction of the middle barrel portion 12 and insulator nose length portion 13, and the insulator 2 is retained on the metal shell 3 by the shoulder 14.

Furthermore, an axial hole 4 is formed in the insulator 2 along the axis CL1 so as to pass through the insulator 2, and a center electrode 5 is inserted and fixed on the leading end side of the axial hole 4. The center electrode 5 is formed in a bar-like (cylindrical) shape overall, and the leading end face thereof is formed to be planar. Also, the leading end face of the center electrode 5 is positioned closer to the axis CL1 direction rear end side than the leading end of the insulator 2.

In addition, the center electrode 5 is configured of a main body portion 5M including an inner layer 5A formed from copper, a copper alloy, or the like, with superior thermal conductivity and an outer layer 5B formed from a nickel (Ni)-based Ni alloy [for example, Inconel (registered trademark) 600 or 610], and a protruding portion 5P is formed adjoining to the main body portion 5M and closer to the axis CL1 direction leading end side than the main body portion 5M.

Figure 2:
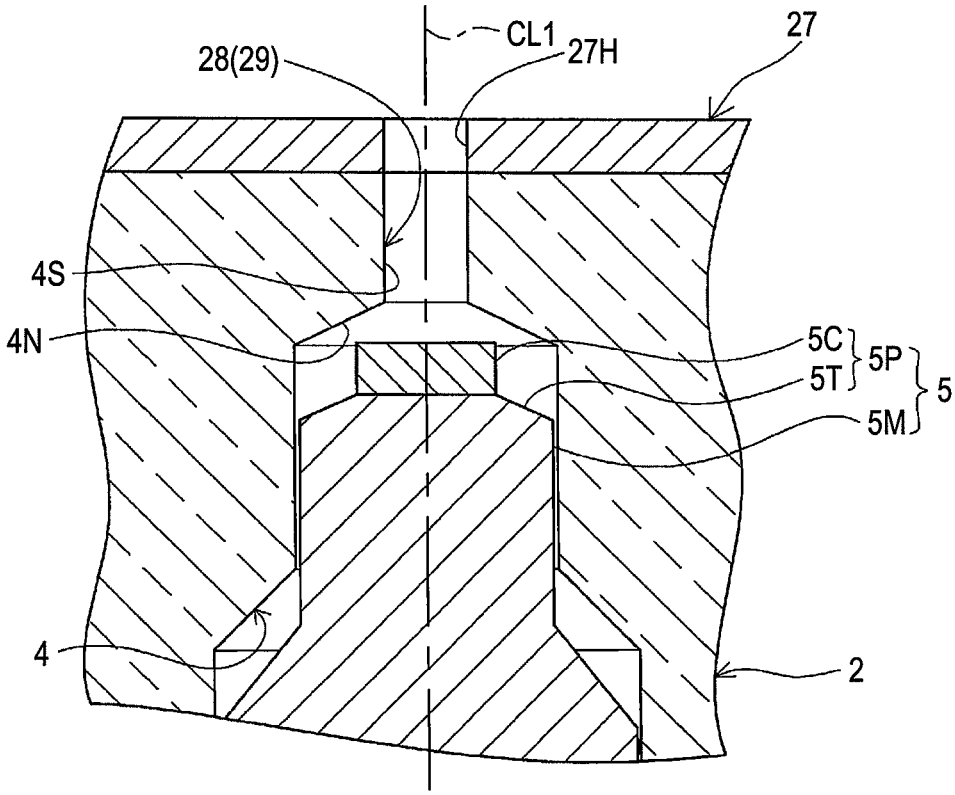
FIG. 2 is a partially enlarged sectional view showing a configuration of a leading end portion of the ignition plug.

The main body portion 5M, forming a cross-sectional circular shape, is configured in such a way as to have at the leading end thereof an outside diameter the same as the inside diameter of the axial hole 4, as shown in FIG. 2. The "outside diameter of the main body portion 5M being the same as the inside diameter of the axial hole 4" includes not only a case in which the outside diameter of the main body portion 5M and the inside diameter of the axial hole 4 are exactly the same, but also a case in which there is a slight difference between the outside diameter of the main body portion 5M and the inside diameter of the axial hole 4. In the embodiment, considering a dimension error when manufacturing, or the like, a slight (for example, 0.04 mm or less) clearance is formed between the main body portion 5M and axial hole 4 at the leading end of the main body portion 5M.

The protruding portion 5P includes a tapered portion 5T whose outside diameter decreases gradually from the leading end of the main body portion 5M toward the axis CL1 direction leading end side, and a cylindrical portion 5C extending from the leading end of the tapered portion 5T toward the axis CL1 direction leading end side. Also, the outside diameter of the protruding portion 5P (cylindrical portion 5C) is made smaller than the outside diameter of the leading end of the main body portion 5M, and a comparatively large, annular space is formed between the outer peripheral surface of the protruding portion 5P and the inner peripheral surface of the axial hole 4. In the embodiment, in order to improve wear resistance, the cylindrical portion 5C is formed from tungsten (W), iridium (Ir), platinum (Pt), nickel (Ni), or an alloy with at least one kind, among these metals, as a primary component, and the outside diameter of the protruding portion 5P is made comparatively large (for example, 0.5 mm or more and 1.5 mm or less).

Returning to FIG. 1, a terminal electrode 6 is inserted and fixed on the rear end side of the axial hole 4 in a condition in which it protrudes from the rear end of the insulator 2.

Furthermore, a cylindrical glass seal layer 9 is disposed between the center electrode 5 and terminal electrode 6 in the axial hole 4, and the center electrode 5 and terminal electrode 6 are electrically connected to each other via the glass seal layer 9.

In addition, the metal shell 3 is formed in a hollow cylindrical shape from a metal such as a low carbon steel, and a threaded portion (an externally threaded portion) 15 for mounting the ignition plug 1 in a mounting hole of a combustion device (for example, an internal combustion engine or a fuel cell reformer) is formed on the outer peripheral surface of the metal shell 3. Also, a seat 16 is formed on the outer peripheral surface on the rear end side of the threaded portion 15, and a ring-like gasket 18 is fitted around a thread neck 17 at the rear end of the threaded portion 15. Furthermore, a tool engagement portion 19 of hexagonal cross section for engaging a tool such as a wrench when mounting the metal shell 3 in the combustion device is provided, as well as a caulked portion 20 for holding the insulator 2 at the rear end portion of the metal shell 3 being provided, on the rear end side of the metal shell 3. Moreover, an annular fitting portion 21 formed so as to protrude toward the axis CL1 direction leading end side is formed on the rim of the leading end portion of the metal shell 3, and a ground electrode 27, to be described hereafter, is fitted within the fitting portion 21.

Also, a tapered shoulder 22 for retaining the insulator 2 is provided on the inner peripheral surface of the metal shell 3. Then, the insulator 2 is inserted from the rear end side toward the leading end side of the metal shell 3, and fixed to the metal shell 3 by caulking the rear end side opening portion of the metal shell 3 inward in the radial direction, that is, forming the caulked portion 20, in a condition in which the shoulder 14 of the insulator 2 is retained by the shoulder 22 of the metal shell 3. An annular plate packing 23 is interposed between the shoulders 14 and 22 of both the insulator 2 and metal shell 3. Because of this, the interior of a combustion chamber is maintained airtight, thus preventing a fuel gas infiltrating into a clearance between the insulator 2 nose length portion 13 and metal shell 3 inner peripheral surface from leaking to the exterior.

Furthermore, in order to make a caulking seal more complete, annular ring members 24 and 25 are interposed between the metal shell 3 and insulator 2 on the rear end side of the metal shell 3, and a space between the ring members 24 and 25 is filled with talc 26 powder. That is, the metal shell 3 holds the insulator 2 across the plate packing 23, ring members 24 and 25, and talc 26.

Also, the disk-like (for example, 0.3 mm or more and 1.0 mm or less thick) ground electrode 27 is joined to the leading end portion of the metal shell 3. Specifically, the ground electrode 27 is joined to the metal shell 3 by the outer circumferential portion thereof being welded to the fitting portion 21 in a condition in which it is fitted within the fitting portion 21 of the metal shell 3. Also, the ground electrode 27 is disposed closer to the axis CL1 direction leading end side than the leading end of the insulator 2, and the insulator 2 side surface of the ground electrode 27 is in contact with the leading end face of the insulator 2. Furthermore, the ground electrode 27 has in the center thereof a through hole 27H passing through in a thickness direction, and a cavity portion 28, to be described hereafter, and the exterior are in communication via the through hole 27H. In the embodiment, in order to improve wear resistance, the ground electrode 27 is configured from W, Ir, Pt, Ni, or an alloy with at least one kind, among these metals, as a primary component.

In addition, as shown in FIG. 2, the cavity portion 28, which is a space formed by being surrounded by the insulator 2 and center electrode 5 with the leading end of the axial hole 4 as an opening end, is provided on the leading end side of the insulator 2. Then, after a spark discharge has been caused by applying a high voltage to a gap 29 formed between the center electrode 5 and ground electrode 27, power is supplied to the gap 29 to shift a discharge condition, thereby generating plasma in the cavity portion 28, and emitting the plasma from the through hole 27H.

Next, a detailed description will be given of a shape of the axial hole 4, a positional relationship between the axial hole 4 and center electrode 5, and the like, which are characteristic portions of the embodiment.

Figure 3:
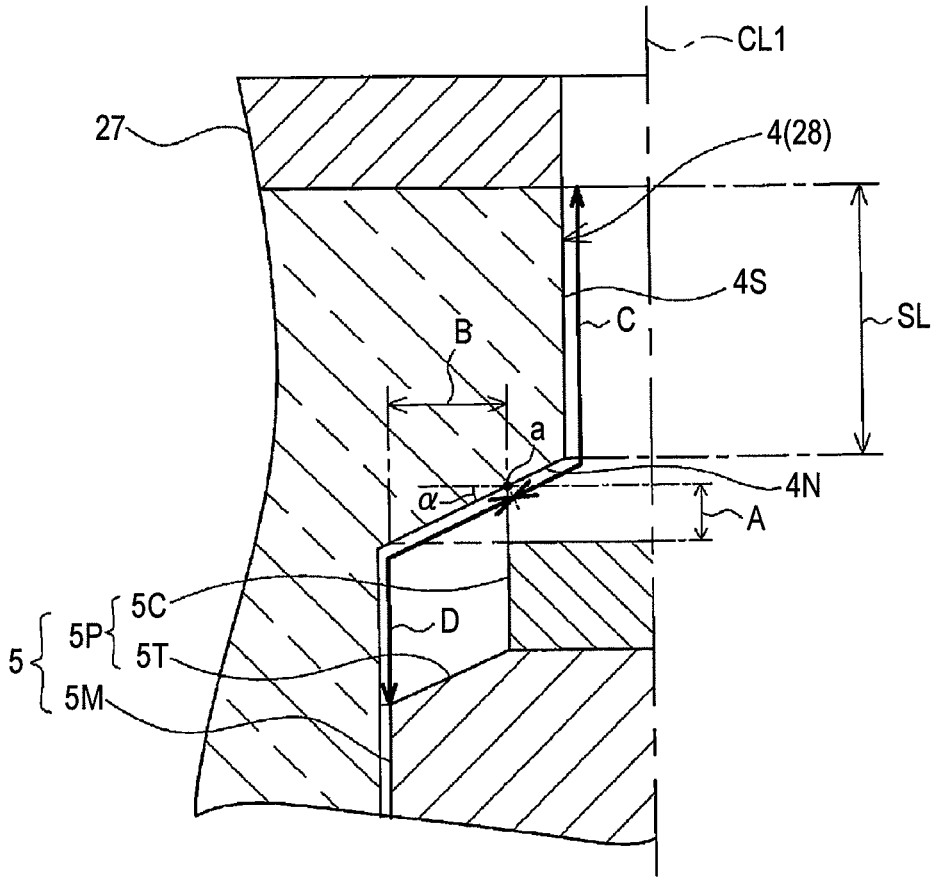

In the embodiment, a tapered decreasing diameter portion 4N whose diameter decreases gradually toward the axis CL1 direction leading end side is provided on the axial hole 4. The decreasing diameter portion 4N is configured in such a way that the leading end thereof is positioned closer to the axis CL1 direction leading end side than the leading end face of the center electrode 5, while the rear end thereof is positioned closer to the axis CL1 direction rear end side than the leading end face of the center electrode 5. Furthermore, the inside diameter of the leading end of the decreasing diameter portion 4N is set so as to be smaller than the outside diameter of the leading end face (protruding portion 5P) of the center electrode 5. That is, a configuration is adopted such that at least the outer circumference side of the leading end face of the center electrode 5 is opposed to the decreasing diameter portion 4N in the axis CL1 direction. In addition, when the degree of an acute angle among the angles formed by the visible outline of the decreasing diameter portion 4N and a straight line perpendicular to the axis CL1, as shown in FIG. 3, on a section including the axis CL1, is taken to be $\alpha^{\circ}$, a configuration is adopted such that $10 \leqq \alpha \leqq 35$ is satisfied.

In the embodiment, by the positional relationship between the decreasing diameter portion 4N and center electrode 5, and the shapes of the center electrode 5 and decreasing diameter portion 4N, being set as heretofore described, when a shortest distance between the leading end face of the center electrode 5 and a region on the decreasing diameter portion 4N opposed to the leading end face of the center electrode 5 in the axis CL1 direction is taken to be A (mm), and a shortest distance in a direction perpendicular to the axis CL1 between the outer circumference of the leading end face of the center electrode 5 and the inner peripheral surface of the axial hole 4 (decreasing diameter portion 4N) is taken to be B (mm), a configuration is adopted such that $A \leqq B$ is satisfied. Consequently, a configuration is adopted such that an aerial discharge occurs down inside the cavity portion 28 in a direction approximately parallel to the axis CL1, between the leading end face of the center electrode 5 and the decreasing diameter portion 4N, when a spark discharge is caused in the gap 29, and such that the decreasing diameter portion 4N is positioned around an aerial discharge path.

Furthermore, a straight portion 4S, extending from the leading end of the decreasing diameter portion 4N to the opening of the cavity portion 28 (the leading end of the axial hole 4), which has a constant inside diameter (for example, 0.3 mm or more and 1.0 mm or less) is formed on the axial hole 4, and the cavity portion 28 is formed in a shape wherein it has a region whose inside diameter decreases gradually from the rear end of the cavity portion 28 toward the axis CL1 direction leading end side and a region whose inside diameter is constant. That is, the cavity portion 28 is configured in such a way that no region whose diameter increases toward the axis CL1 direction leading end side is formed (in other words, the cavity portion 28 is such that the inside diameter is the same or decreases toward the axis CL1 direction leading end side, and the inside diameter of the leading end of the axial hole 4 is made smaller than an inside diameter of the cavity portion 28 on a plane including the leading end face of the center electrode 5).

The phrase "constant inside diameter" means not only an inside diameter which is absolutely constant in the axis CL1 direction, but also an inside diameter which varies slightly in the axis CL1 direction. Consequently, on the section including the axis CL1, the visible outline of the inner peripheral surface of the straight portion 4S may incline slightly (for example, up to)±5°) with respect to the axis CL1.

In addition, a length SL of the straight portion 4S in the axis CL1 direction is made sufficiently large at 0.3 mm or more.

Furthermore, in the embodiment, a configuration is adopted such that the shortest distance A satisfies $0.05 \leqq A \leqq 0.5$. Also, when a shortest distance along the insulator 2 inner peripheral surface between a point "a" on the decreasing diameter portion 4N inner peripheral surface, which forms the shortest distance A, and the ground electrode 27 is taken to be C (mm), a configuration is adopted such that $A+(C\times0.5) \leqq 1.50$ is satisfied.

In addition, when a shortest distance along the insulator 2 inner peripheral surface between the point "a" and the main body portion 5M of the center electrode 5 is taken to be D (mm), a configuration is adopted such that $A\times2 \leqq D$ is satisfied.

Figure 4:
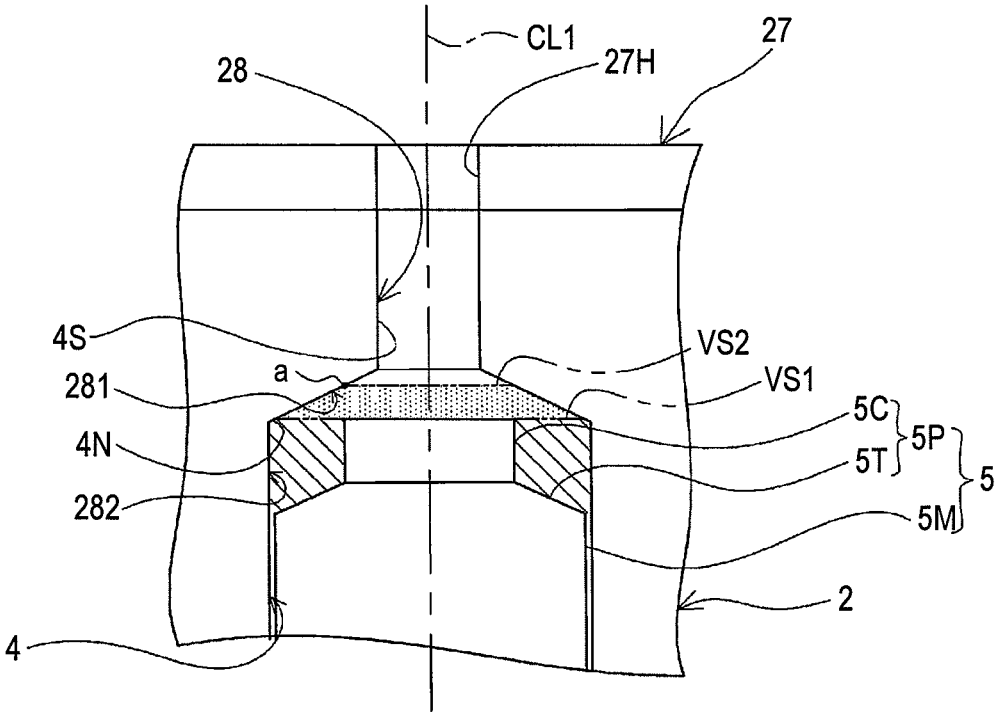
FIG. 4 is an enlarged sectional schematic view for illustrating a first cavity portion and second cavity portion.

Moreover, when the volume of a first cavity portion 281 (in FIG. 4, the region with the scattered dot pattern) is taken to be V1 ($mm^3$), and the volume of a second cavity portion 282 (in FIG. 4, the hatched region) is taken to be V2 ($mm^3$), as shown in FIG. 4 (in FIG. 4, for simplicity of illustration, the hatching of the insulator 2 and the like are omitted), a configuration is adopted such that $V2 \leqq V1\times5$ is satisfied.

The first cavity portion 281 refers to a space in the cavity portion 28 defined by a virtual plane VS1 including the leading end face of the center electrode 5, a virtual plane VS2, perpendicular to the axis CL1, including the point "a," and the inner peripheral surface of the axial hole 4 (decreasing diameter portion 4N). Also, the second cavity portion 282 refers to a space in the cavity portion 28 defined by the virtual plane VS1, the outer peripheral surface of the center electrode 5 (protruding portion 5P), and the inner peripheral surface of the axial hole 4. In addition, in the embodiment, the outside diameter of the rear end of the decreasing diameter portion 4N is set to a predetermined value (for example, 1.0 mm or more and 2.0 mm or less) so that it is possible to prevent an excessive increase in the volume V2 of the second cavity portion 282 while satisfying $A \leqq B$.

As heretofore described in detail, according to the embodiment, a configuration is adopted such that an aerial discharge occurs in a direction approximately parallel to the axis CL1, between the leading end face of the center electrode 5 and the decreasing diameter portion 4N, when a spark discharge is caused, and such that the inner peripheral surface of the decreasing diameter portion 4N is positioned around this aerial discharge path. Consequently, plasma generation in the aerial discharge path occurs down inside the cavity portion 28 in a condition in which the inner peripheral surface of the decreasing diameter portion 4N exists on the outer circumference side. Because of this, it is possible to suppress an expansion of plasma to the outer circumference side, and it is possible to generate higher-temperature and higher-pressure plasma. In addition, as the existence of the decreasing diameter portion 4N makes it difficult for plasma in the aerial discharge path to leak out to the opening side of the cavity portion 28 during plasma generation, it is possible to generate still higher-temperature and higher-pressure plasma. Moreover, by $A \leqq B$ being set to allow an aerial discharge and thus plasma to be generated in a direction approximately parallel to the axis, it is possible to smoothly emit plasma from the opening of the cavity portion 28. By these working effects acting synergistically, it is possible to very effectively increase the length of emission of plasma from the opening of the cavity portion 28. As a result of this, it is possible to dramatically improve ignitability.

Also, as the angle $\alpha$ is set to 35° or less, it is possible to more reliably suppress an instantaneous diffusion in the axis CL1 direction of plasma generated in the aerial discharge path. Consequently, it is possible to generate still higher-pressure plasma in a space on the inner peripheral side of the decreasing diameter portion 4N. As a result of this, it is possible to further increase the length of emission of plasma from the opening of the cavity portion 28, and it is possible to further improve ignitability.

Also, as the angle $\alpha$ is set to 10° or more, it is possible to more reliably prevent plasma generated in the aerial discharge path from flowing into the space between the outer peripheral surface of the protruding portion 5P and the inner peripheral surface of the axial hole 4. As a result of this, it is possible to further increase the force of emission of plasma toward the opening side of the cavity portion 28, and it is possible to still further improve ignitability.

In addition, the cavity portion 28 is configured having no region whose inside diameter increases toward the axis CL1 direction leading end side. Consequently, it is possible to more reliably suppress an expansion of plasma to the outer circumference side and a diffusion of plasma when emitted from the opening of the cavity portion 28. As a result of this, it is possible to further increase the length of emission of plasma, and it is possible to achieve a further improvement in ignitability.

Furthermore, a configuration is adopted such that the volume V1 (mm3) of the first cavity portion 281 and the volume V2 ($mm^3$) of the second cavity portion 282 satisfy $V2 \leqq V1\times5$. Consequently, it is possible to sufficiently fill the second cavity portion 282 with plasma generated in the aerial discharge path (first cavity portion 281), and it is possible to emit plasma toward the leading end side with a high pressure.

Also, as the straight portion 4S is provided on the outermost leading end portion of the axial hole 4, and the length SL of the straight portion 4S along the axis CL1 is set to 0.3 mm or more, a thickness in the axis CL1 direction of a region of the insulator 2 positioned on the leading end inner periphery side thereof is made sufficiently large. Consequently, it is possible to prevent the inner peripheral surface of the insulator 2 from being locally cut deep as a result of a spark discharge, and it is possible to cause a channeling approximately evenly in a circumferential direction. As a result of this, it is possible to more reliably prevent a rapid decrease in ignitability.

Moreover, as the shortest distance A is made sufficiently long at 0.05 mm or more, it is possible to further enhance the effectiveness of an improvement in ignitability owing to plasma being generated in the aerial discharge path.

Meanwhile, a configuration is adopted such that the shortest distances A and C satisfy $A+(C\times0.5) \leqq 1.50$ and $A \leqq 0.5$. Because of this, it is possible to keep an initial discharge voltage comparatively low, and it is possible to more effectively suppress a discharge anomaly (a misfire), or a progress of a channeling, induced by an increase in discharge voltage.

In addition, because the main body portion 5M, which is larger in diameter than the protruding portion 5P, is formed on the rear end side of the protruding portion 5P, it is possible to efficiently transfer the heat of the protruding portion 5P to the metal shell 3 side via the main body portion 5M. Consequently, it is possible to suppress wear of the center electrode 5 induced by a spark discharge or the like, and it is possible to more reliably prevent a rapid increase in discharge voltage.

As a result of this, it is possible to prevent an occurrence of a discharge anomaly (a misfire) or a progress of a channeling over a long period, and it is thus possible to maintain superior ignitability for a longer period.

Also, as a configuration is adopted such that the shortest distances A and D satisfy $A \times 2 \leqq D$, a configuration is adopted such that a discharge voltage needed for an aerial discharge between the point "a" and the leading end face of the center electrode 5 is equal to or lower than a discharge voltage needed for a creeping discharge between the point "a" and the main body portion 5M. Consequently, it is possible to more reliably cause an aerial discharge between the leading end face of the center electrode 5 and the decreasing diameter portion 4N.

Figure 5:
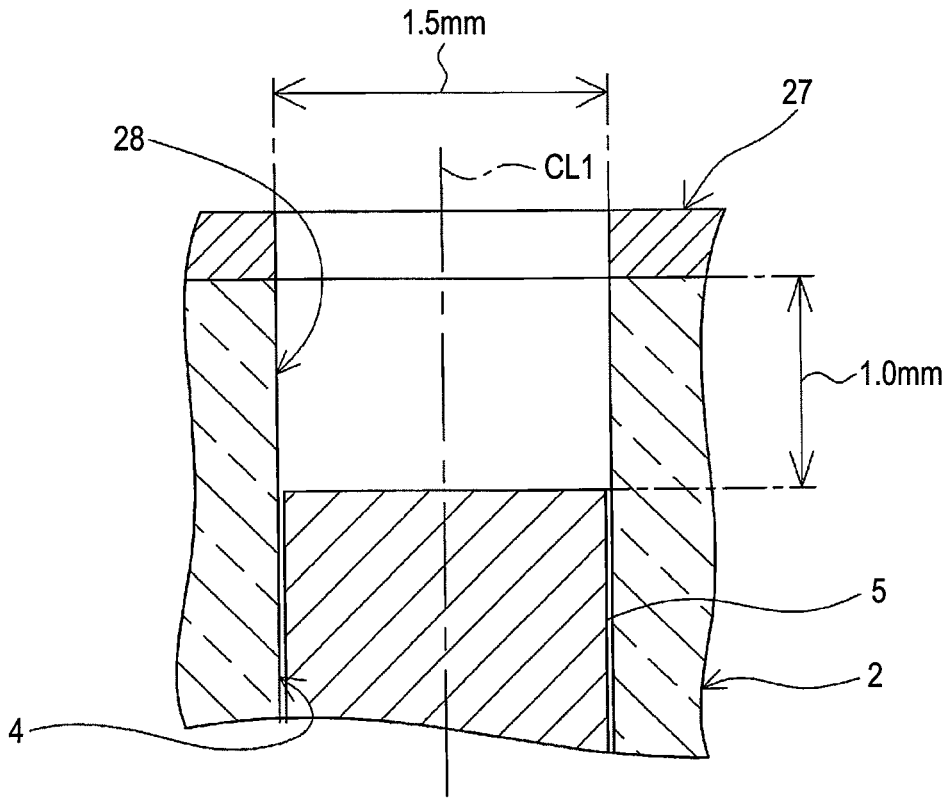
FIG. 5 is a partially enlarged sectional view showing a configuration of a leading end portion of a reference sample L.

Next, in order to confirm the working effects achieved by the heretofore described embodiment, an ignitability evaluation test is carried out on ignition plug samples E corresponding to a comparison example and ignition plug samples F corresponding to a working example. The outline of the ignitability evaluation test is as follows. Firstly, as shown in FIG. 5, there is fabricated an ignition plug sample (a reference sample L) configured in such a way that the cavity portion is provided with no decreasing diameter portion on the axial hole and has a predetermined inside diameter (1.5 mm), and configured in such a way that a spark discharge occurs along only a creeping discharge path (1.0 mm in length) creeping along the inner peripheral surface of the insulator. Then, after the reference sample L has been mounted in a predetermined chamber, the pressure in the chamber is set to 0.4 MPa, and the atmosphere in the chamber is made a standard gas atmosphere (an ambient air atmosphere). Next, plasma is generated with input energy set to 50 mJ, and a schlieren image of plasma (a flame) emitted from the cavity portion is obtained 100 μs after a spark discharge. Then, the obtained schlieren image is binarized using a predetermined threshold, and the area of a high-density portion (that is, a portion from which plasma has been emitted) is measured as a flame area reference (a reference flame area). After that, with the samples E and F, plasma is generated under conditions the same as heretofore described, and the flame area of each of them is measured. Then, the ratio of the measured flame area to the reference flame area (a flame area improvement ratio) is calculated. The higher the flame area improvement ratio, the larger the area of plasma emitted, and this means that ignitability is superior.

Figure 6:
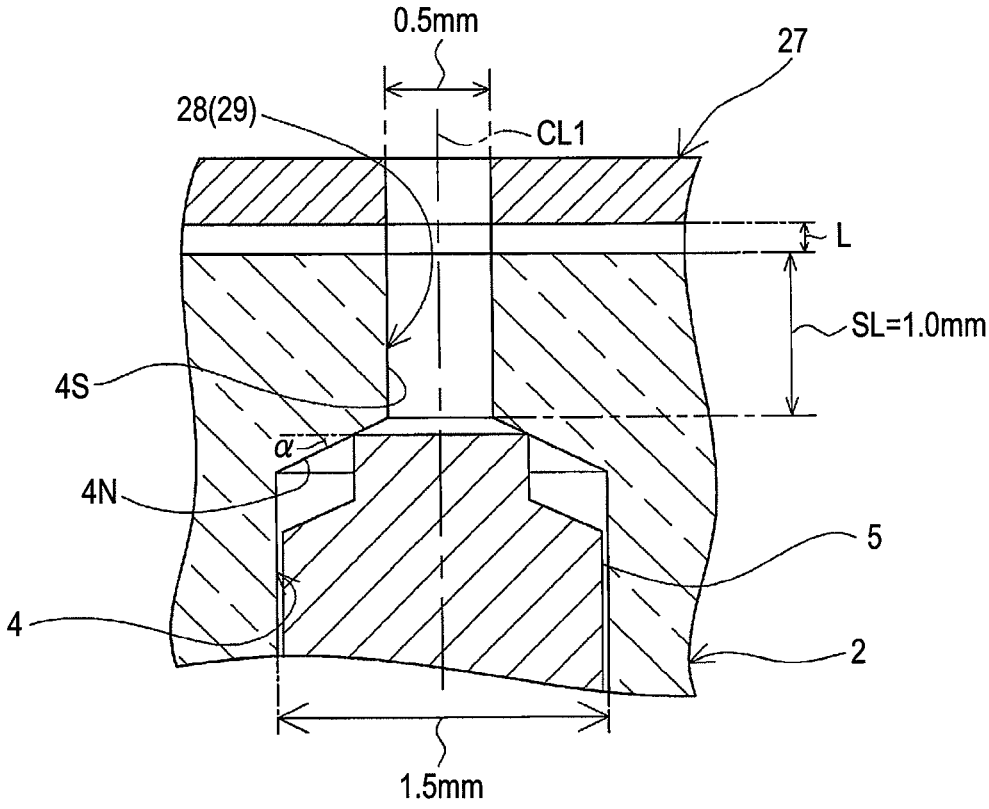
FIG. 6 is a partially enlarged sectional view showing a configuration of a leading end portion of a sample E.
Figure 7:
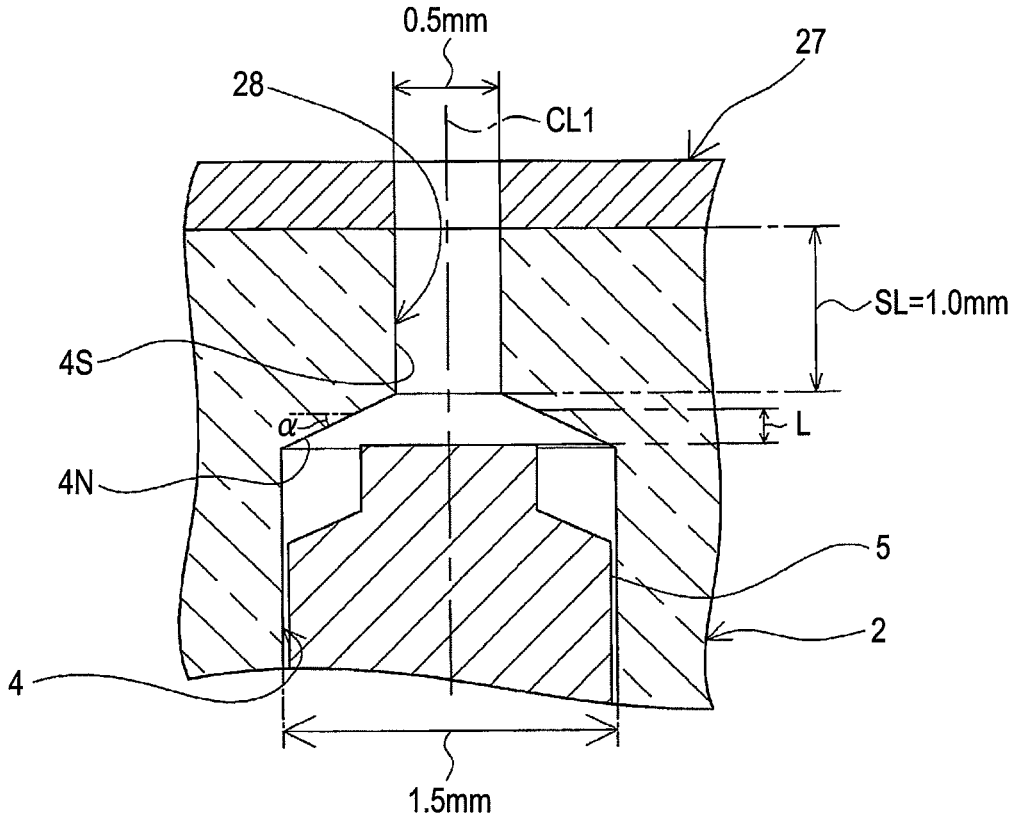
FIG. 7 is a partially enlarged sectional view showing a configuration of a leading end portion of a sample F.

The samples E are such that the leading end face of the center electrode is brought into approximate contact with the decreasing diameter portion of the axial hole (there exists a very small clearance), while a clearance is provided between the leading end face of the insulator and the ground electrode, as shown in FIG. 6, wherein a configuration is adopted such that a spark discharge occurs along a creeping discharge path creeping along the insulator inner peripheral surface from the leading end face of the center electrode to the leading end of the axial hole and an aerial discharge path passing through the air from the leading end of the axial hole to the ground electrode. The samples E are such that a length L of the aerial discharge path along the axis is variously changed. Also, the samples F are such that a space is provided between the leading end face of the center electrode and the axial hole (decreasing diameter portion) in the axis direction, while the leading end face of the insulator is brought into contact with the ground electrode, as shown in FIG. 7, wherein a configuration is adopted such that a spark discharge occurs along an aerial discharge path passing through the air from the leading end face of the center electrode to the axial hole (decreasing diameter portion) and a creeping discharge path creeping along the insulator inner peripheral surface from the axial hole (decreasing diameter portion) to the ground electrode. The samples F are such that a length L of the aerial discharge path along the axis is variously changed. That is, both samples are configured in such a way that an aerial discharge occurs, but the samples E are configured in such a way that an aerial discharge occurs closer to the leading end side than the cavity portion, while the samples F are configured in such a way that an aerial discharge occurs down inside the cavity portion.

Figure 8:
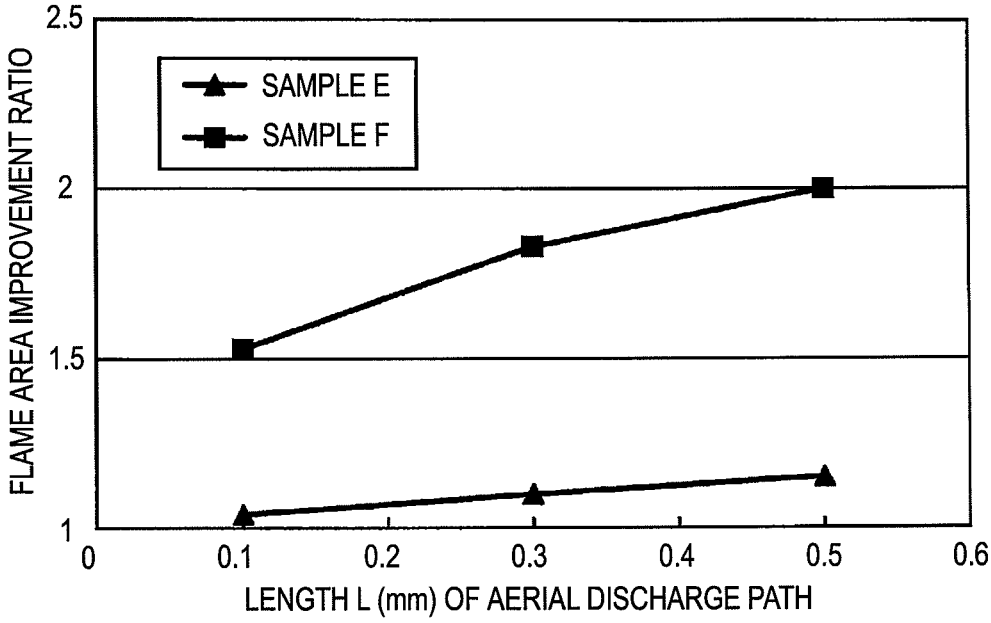
FIG. 8 is a graph showing results of an ignitability evaluation test on the samples E and F.

Results of the test are shown in FIG. 8. In FIG. 8, the test results of the samples E are plotted with triangles, and the test results of the samples F are plotted with squares. Also, both the samples E and F are such that the inside diameter of the rear end of the decreasing diameter portion is set to 1.5 mm, the inside diameter of the leading end of the axial hole is set to 0.5 mm, the length SL of the straight portion is set to 1.0 mm, and the angle α of the decreasing diameter portion is set to 20°. In addition, the samples F are configured in such a way that the shortest distances A and B satisfy $A \leqq B$.

Both samples are configured in such a way that plasma is generated by an aerial discharge in a condition in which there is nothing around to suppress a spreading, but it is revealed, as shown in FIG. 8, that the samples F configured in such a way that an aerial discharge occurs down inside the cavity portion have very superior ignitability as the flame area improvement ratio increases dramatically. It is conceivable that this is because an expansion of plasma when generated is suppressed, and high-temperature and high-pressure plasma is generated, by causing an aerial discharge in a condition in which the inner peripheral surface of the axial hole exists peripherally down inside the cavity portion.

Figure 9:
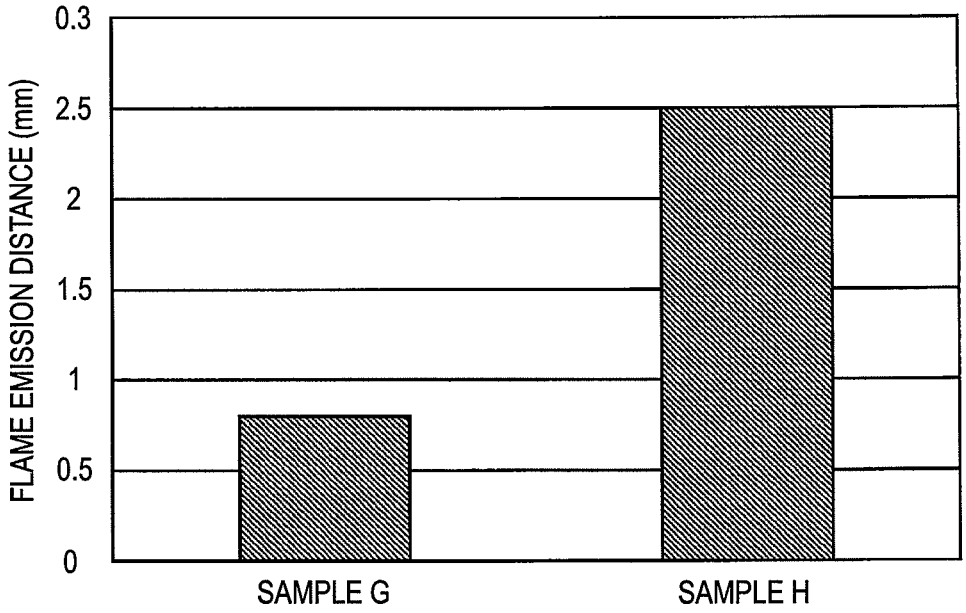
FIG. 9 is a graph showing results of an emission distance measurement test on samples G and H.

Next, an emission distance measurement test is carried out on an ignition plug sample G corresponding to a comparison example and an ignition plug sample H corresponding to a working example. The outline of the emission distance measurement test is as follows. That is, after the samples have been mounted in a predetermined chamber, the pressure in the chamber is set to 0.4 MPa, and the atmosphere in the chamber is made a standard gas atmosphere (an ambient air atmosphere). Next, plasma is generated with input energy set to 100 mJ, and a schlieren image of plasma emitted from the cavity portion is obtained 100 μs after a spark discharge. Then, the obtained schlieren image is binarized using a predetermined threshold, and the length of emission from a sample leading end of a high-density portion is measured as a flame emission distance. Results of the test are shown in FIG. 9. The larger the flame emission distance means the more superior ignitability is.

Figure 10:
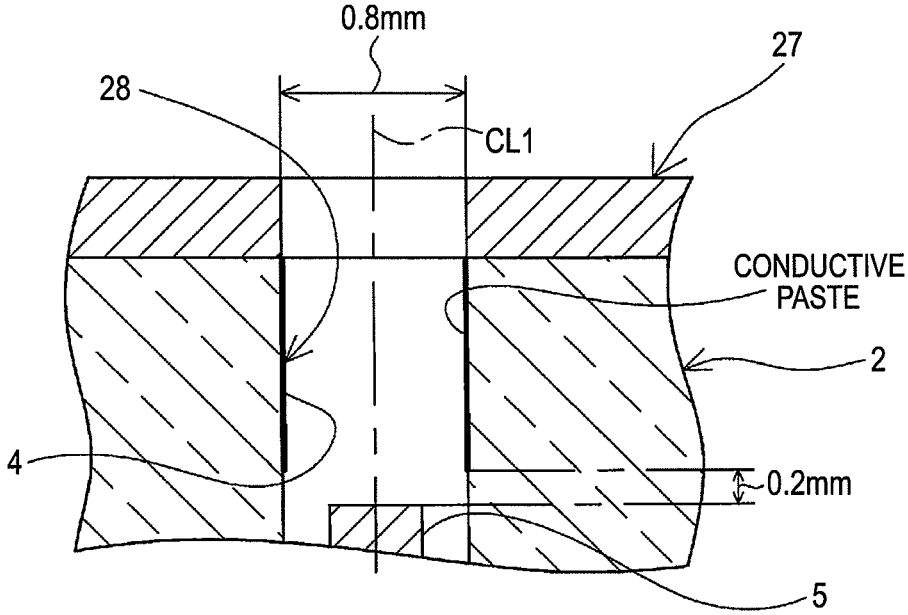
FIG. 10 is a partially enlarged sectional view showing a configuration of a leading end portion of the sample G.
Figure 11:
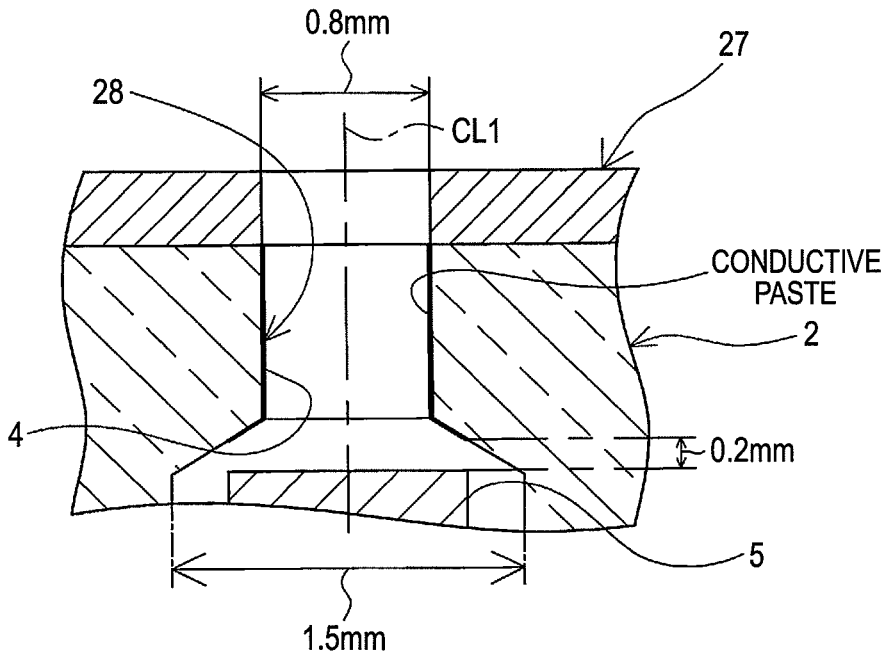
FIG. 11 is a partially enlarged sectional view showing a configuration of a leading end portion of the sample H.

Also, the sample G, as well as being configured in such a way that the cavity portion has a constant inside diameter, as shown in FIG. 10, is configured in such a way that the center electrode is made small in diameter to allow an aerial discharge to occur in a direction oblique with respect to the axis. Meanwhile, the sample H is configured in such a way that the decreasing diameter portion is provided on the axial hole, as shown in FIG. 11, and a configuration is adopted such that the shortest distances A and B satisfy $A \leqq B$, thereby allowing an aerial discharge to occur in a direction approximately parallel to the axis, and that the decreasing diameter portion is positioned around the aerial discharge path.

In addition, both samples G and H are configured in such a way that the lengths of their aerial discharge paths along the axis are the same (0.2 mm) by applying conductive paste to the inner peripheral surface of the cavity portion, thus preventing the effect of a difference in length between the aerial discharge paths. Also, the sample G is such that the inside diameter of the cavity portion is set to 0.8 mm, and the sample H is such that the inside diameter of the rear end of the decreasing diameter portion is set to 1.5 mm, and the inside diameter of the leading end of the cavity portion is set to 0.8 mm.

It is found, as shown in FIG. 9, that the sample H has very superior ignitability as the flame emission distance is very large. It is conceivable that this is because plasma is smoothly emitted from the opening of the cavity portion by the existence of the decreasing diameter portion making it difficult for plasma to leak out from the opening of the cavity portion during plasma generation, and by A≦B being set to allow an aerial discharge to occur in a direction approximately parallel to the axis.

According to the results of both tests, it can be said that it is preferable, in order to improve ignitability, to adopt a configuration such that an aerial discharge occurs in a direction approximately parallel to the axis, between the leading end face of the center electrode and the decreasing diameter portion, when a spark discharge is caused, and such that the inner peripheral surface of the axial hole is positioned around this aerial discharge path, and the decreasing diameter portion is positioned around at least the leading end side of the aerial discharge path.

Figure 12:
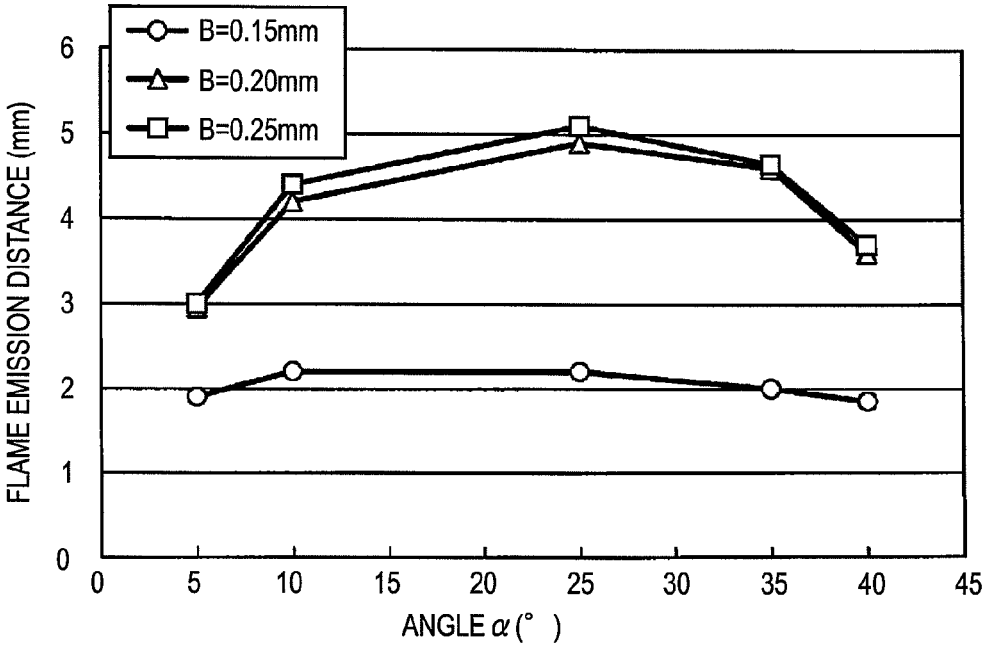
FIG. 12 is a graph showing results of the emission distance measurement test on samples wherein an angle α is variously changed.

Next, there are fabricated ignition plug samples wherein the angle α is variously changed after the relational expression between the shortest distances A and B has been caused to vary by setting the shortest distance B to 0.15 mm, 0.20 mm, or 0.25 mm, while the shortest distance A is set to 0.20 mm, and the emission distance measurement test is carried out on each sample. Results of the test are shown in FIG. 12. Test results of the samples with the shortest distance B set to 0.15 mm, wherein A>B is set, are indicated by circles, test results of the samples with the shortest distance B set to 0.20 mm, wherein A=B is set, are indicated by triangles, and test results of the samples with the shortest distance B set to 0.25 mm, wherein A<B is set, are indicated by squares.

It is revealed, as shown in FIG. 12, that the samples configured in such a way that A≦B is set to allow an aerial discharge to occur in a direction approximately parallel to the axis are such that the flame emission distance increases dramatically by setting the angle α to 10° or more and 35° or less. It is conceivable that this is for the following reasons (1) and (2).

(1) An instantaneous diffusion in the axis direction of plasma generated in an aerial discharge path is suppressed, and higher-pressure plasma is generated, by setting the angle α to 35° or less.

(2) A flow of plasma into the space between the outer peripheral surface of the leading end portion of the center electrode and the inner peripheral surface of the axial hole is suppressed, and the force of emission of plasma toward the opening side of the cavity portion increases, by setting the angle α to 10° or more.

According to the heretofore described test results, it can be said that it is preferable, from the standpoint of further improving ignitability, to set the angle α to 10° or more and 35° or less in an ignition plug configured in such a way that A≦B is satisfied to allow an aerial discharge to occur in a direction approximately parallel to the axis.

Figure 13:
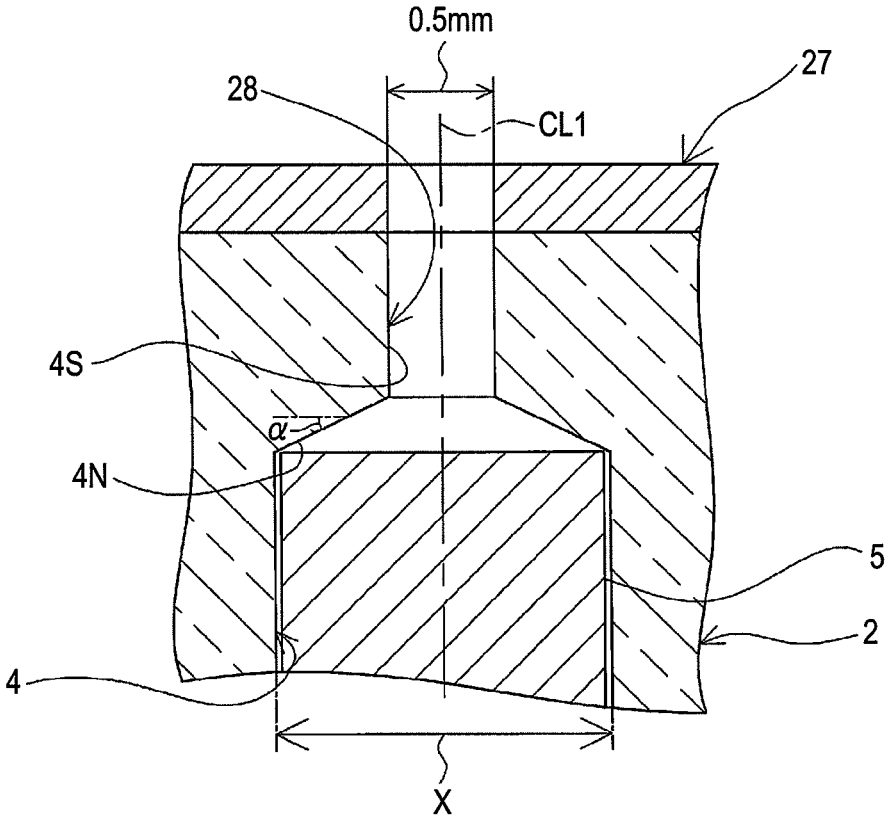
FIG. 13 is a partially enlarged sectional view showing a configuration of a leading end portion of a sample I.
Figure 14:
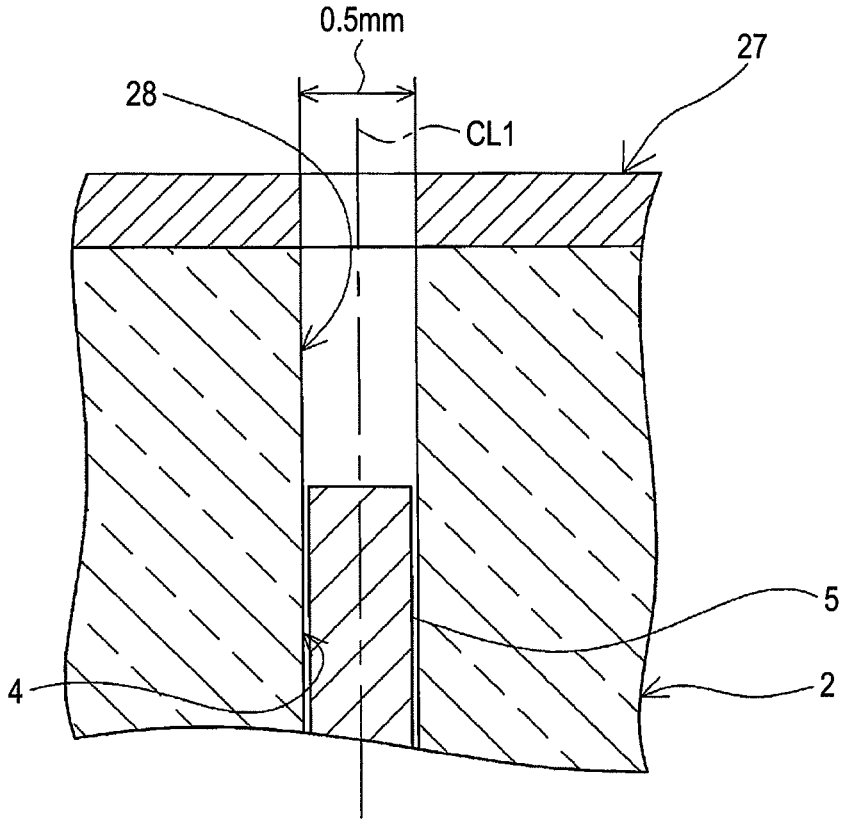
FIG. 14 is a partially enlarged sectional view showing a configuration of a leading end portion of a reference sample M.

Next, the ignitability evaluation test is carried out on ignition plug samples I wherein the decreasing diameter portion and straight portion are provided on the axial hole, as shown in FIG. 13, and an inside diameter X of the rear end of the decreasing diameter portion is variously changed. In the test, with an ignition plug configured in such a way that the cavity portion has a constant inside diameter (0.5 mm) in the axis direction, and only a creeping discharge occurs between the center electrode and ground electrode, as a reference sample M, the flame area improvement ratios of the samples I are calculated based on the flame area of the reference sample M (reference flame area). Results of the test are shown in FIG. 15.

In the test, each sample I is configured in such a way that the inside diameter of the leading end of the axial hole is set to 0.5 mm, and the angle α of the decreasing diameter portion is set to 20°, thus allowing only a creeping discharge to occur between the center electrode and ground electrode with little or no clearance being provided between the center electrode and axial hole.

Figure 15:
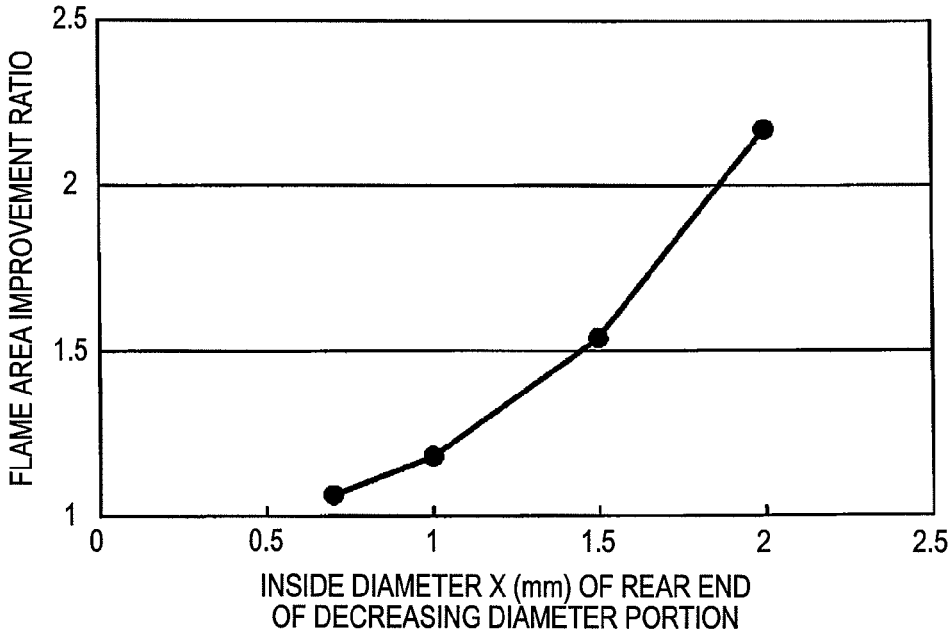
FIG. 15 is a graph showing results of the ignitability evaluation test on the samples I wherein an inside diameter X of the rear end of the decreasing diameter portion is variously changed.

It is confirmed, as shown in FIG. 15, that each sample I has superior ignitability. It is conceivable that this is because the amount of plasma generated increases by the amount of space formed by the decreasing diameter portion, and an expansion of plasma to the outer circumference side, or the like, is reliably suppressed by configuring the cavity portion without increasing the inside diameter thereof.

According to the test results, it can be said that it is preferable, in order to further improve ignitability, that no region whose inside diameter increases toward the axis direction leading end side is provided in the cavity portion, in other words, the cavity portion is formed into a shape wherein the inside diameter decreases gradually from the rear end of the cavity portion toward the axis direction leading end side, or a shape wherein the cavity portion has a region whose inside diameter decreases gradually from the rear end of the cavity portion toward the axis direction leading end side and a region whose inside diameter is constant.

Figure 16:
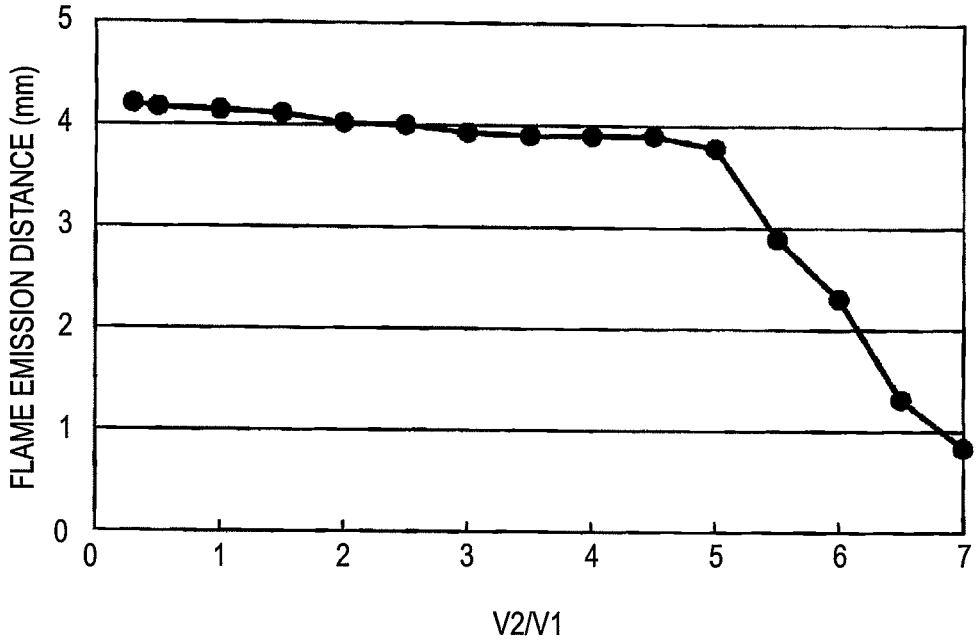
FIG. 16 is a graph showing results of the emission distance measurement test on samples wherein V2/V1 is variously changed.

Next, ignition plug samples wherein the value of V2/V1 is variously changed by changing the volumes V1 and V2 are fabricated, and the emission distance measurement test is carried out on each sample. Results of the tests are shown in FIG. 16. The volumes V1 and V2 are changed by adjusting the outside diameter of the rear end of the decreasing diameter portion after making the inside diameter (0.5 mm) of the straight portion and the length (1.0 mm) thereof along the axis constant.

It is revealed, as shown in FIG. 16, that the samples with V2/V1 set to 5 or less, that is, the samples satisfying V2≦V1×5, are superior in ignitability as the flame emission distance is sufficiently large at approximately 4 mm. It is conceivable that this is because it is possible to fill the space forming the volume V2 with plasma generated in the space forming the volume V1, and it is thus possible to sufficiently ensure the force of emission of plasma toward the leading end side.

According to the test results, it is preferable, in order to achieve a further improvement in ignitability, to set the volumes V1 and V2 so as to satisfy V2≦V1×5.

Figure 17:
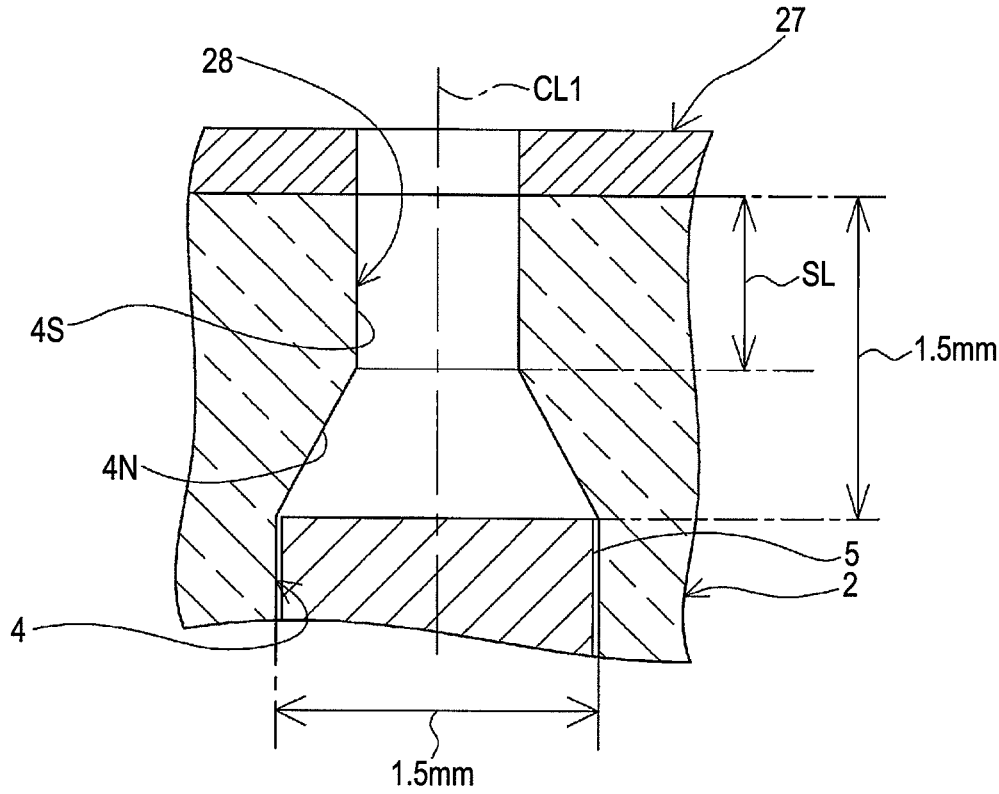
FIG. 17 is a partially enlarged sectional view showing a configuration of a leading end portion of a sample J.

Next, there are fabricated ignition plug samples J wherein the length SL of the straight portion along the axis is variously changed after setting the distance along the axis between the ground electrode and center electrode to 1.5 mm, as shown in FIG. 17, and an endurance evaluation test is carried out on each sample. The outline of the endurance evaluation test is as follows. That is, plasma is emitted by supplying power to each sample, plasma emitted from the side surface side of the samples is imaged, and the area of emission of plasma in an initial condition is measured from the imaged image. After that, after the samples have been mounted in a predetermined chamber, the pressure in the chamber is set to 0.4 MPa, and each sample is discharged (only a spark discharge is caused without supplying power) at an applied voltage frequency of 60 Hz (that is, at a rate of 3600 times per minute). Next, plasma is emitted by supplying power to the samples each time 100 hours elapses, the emitted plasma is imaged from the side surface side of the samples, and the area of emission of plasma is measured from the imaged image. Then, a time in which the measured area of emission of plasma is reduced to a half or less (an endurance time) is specified for the area of emission of plasma in the initial condition. The longer the endurance time means the more it is possible to maintain initial ignitability over a long period.

Figure 18:
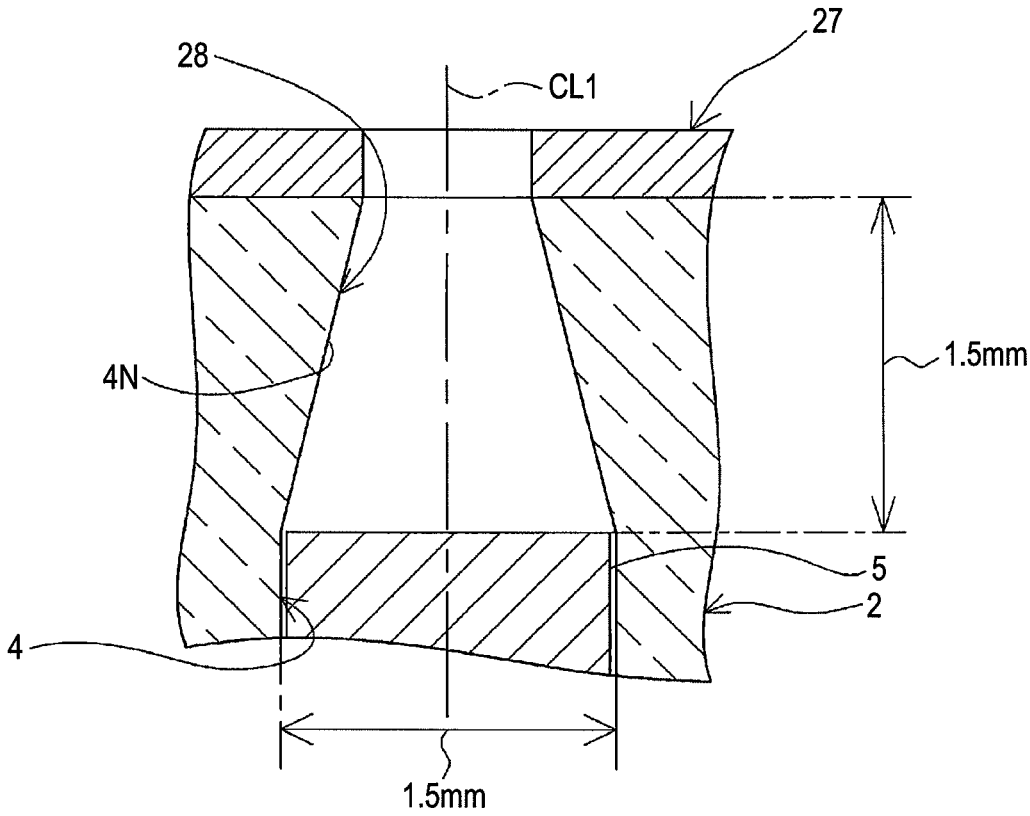
FIG. 18 is a partially enlarged sectional view showing a configuration of a sample wherein a length SL of a straight portion is set to 0 mm.
Figure 19:
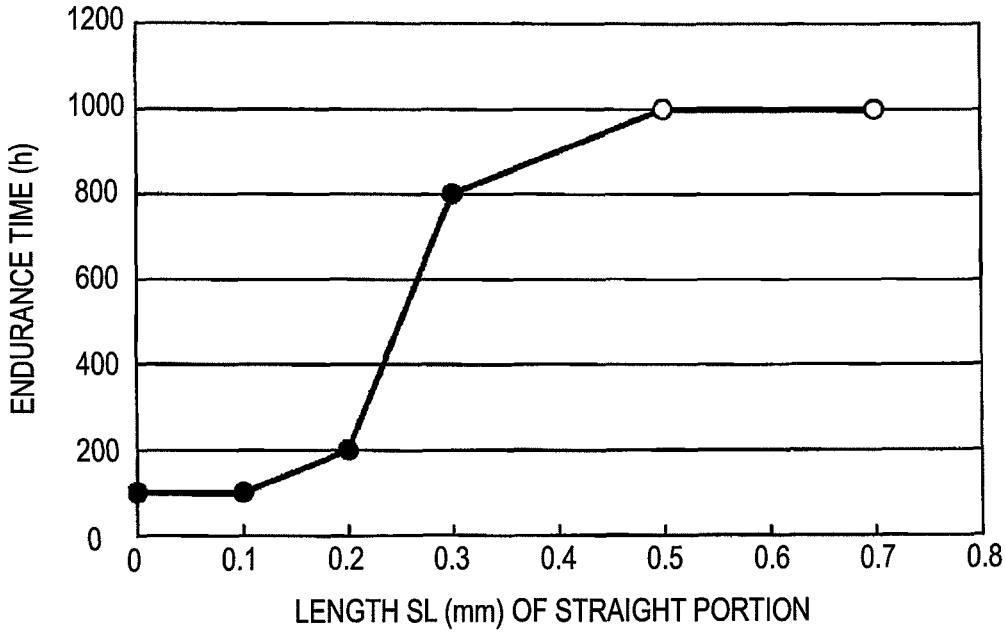
FIG. 19 is a graph showing results of an endurance evaluation test on the samples J wherein the length SL of the straight portion is variously changed.

Results of the test are shown in FIG. 19. A time for which a voltage is applied to each sample is set to a maximum of 100 hours. Also, test results of samples wherein the area of emission of plasma measured at the stage of 1000 hours is larger than a half of the area of emission of plasma in the initial condition are indicated by outlined circles in FIG. 19. In addition, the length SL of the straight portion being 0 mm in FIG. 19 means that the decreasing diameter portion is provided, and no straight portion is provided, on a whole region of the cavity portion in the axis direction, as shown in FIG. 18. Furthermore, each sample is such that the outside diameter of the leading end face of the center electrode and the inside diameter of the rear end of the decreasing diameter portion are set to 1.5 mm. Also, the inside diameter of the leading end of the axial hole and the inside diameter of the through hole of the ground electrode are made the same.

It is confirmed, as shown in FIG. 19, that the samples provided with no straight portion and the samples with the length SL of the straight portion set to less than 0.3 mm are slightly inferior in endurance. It is conceivable that this is for the following reasons. That is, as a leading end side inner peripheral thickness of the insulator in the axis direction is comparatively small, this region is cut deep as a result of a spark discharge. Then, a spark discharge occurs concentrated in the region cut deep (that is, a channeling concentrates locally), and a deep groove is formed in the inner peripheral surface of the axial hole. As a result of this, a spark discharge occurs along the deep groove between the insulator side surface of the ground electrode and the center electrode, and the existence of the ground electrode makes it difficult for plasma to be emitted.

As opposed to this, it is found that the samples with the length SL of the straight portion set to 0.3 mm or more are superior in endurance. It is conceivable that this is because, by making the leading end side inner peripheral thickness of the insulator in the axis direction comparatively large, it is difficult for this region to be cut by a spark discharge, and a channeling thus occurs approximately evenly in the circumferential direction, as a result of which it is difficult for a deep groove to be formed in the inner peripheral surface of the axial hole.

According to the test results, it can be said that it is preferable, in order to maintain superior ignitability over a long period, to set the length SL of the straight portion along the axis to 0.3 mm or more.

Next, there are fabricated ignition plug samples K wherein the length of the shortest distance A is variously changed by changing a position of the center electrode leading end face in the axis direction relative to the decreasing diameter portion, after the shape of the decreasing diameter portion has been made constant, and the ignitability evaluation test is carried out on each sample K. Results of the test are shown in FIG. 20.

Figure 22:
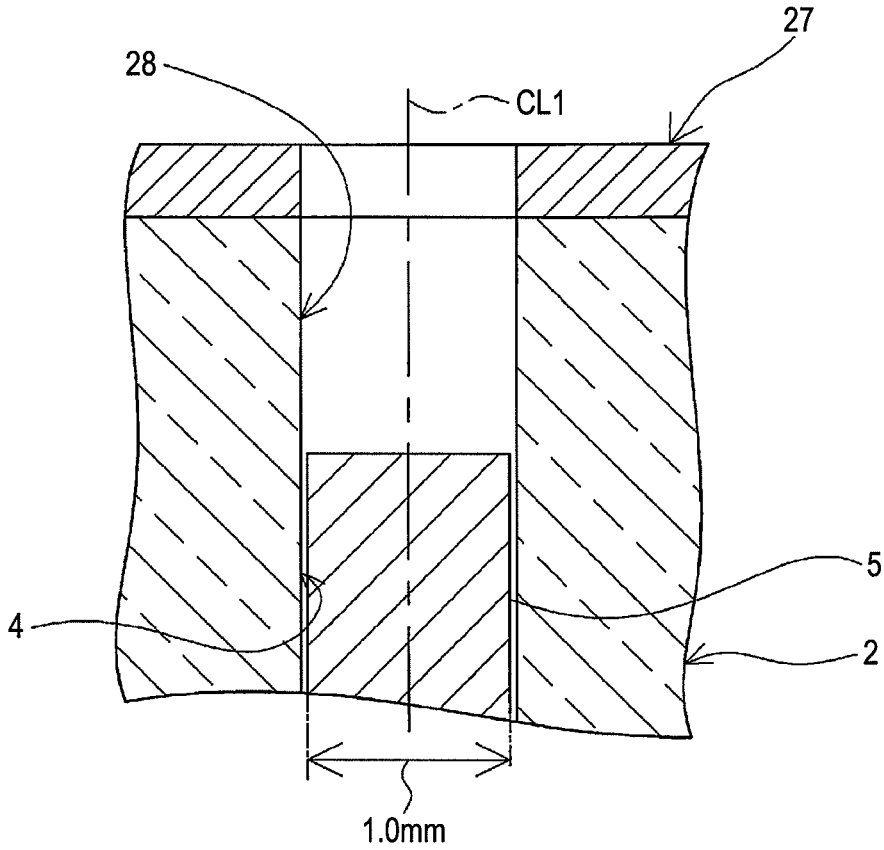
FIG. 22 is a partially enlarged sectional view showing a configuration of a leading end portion of a reference sample N.

Each sample K is such that the inside diameter of the rear end of the decreasing diameter portion is set to 1.5 mm, the inside diameter of the leading end of the axial hole is set to 0.5 mm, and the outside diameter of the leading end face of the center electrode is set to 1.0 mm. Also, in the test, an ignition plug configured in such a way that the cavity portion has an inside diameter (1.0 mm) equal to the outside diameter of the leading end face of the center electrode in the axis direction, as shown in FIG. 22, thus allowing only a creeping discharge to occur between the center electrode and ground electrode, is made a reference sample N, and the flame area improvement ratio of each sample is calculated based on the flame area of the reference sample N (reference flame area).

Figure 20:
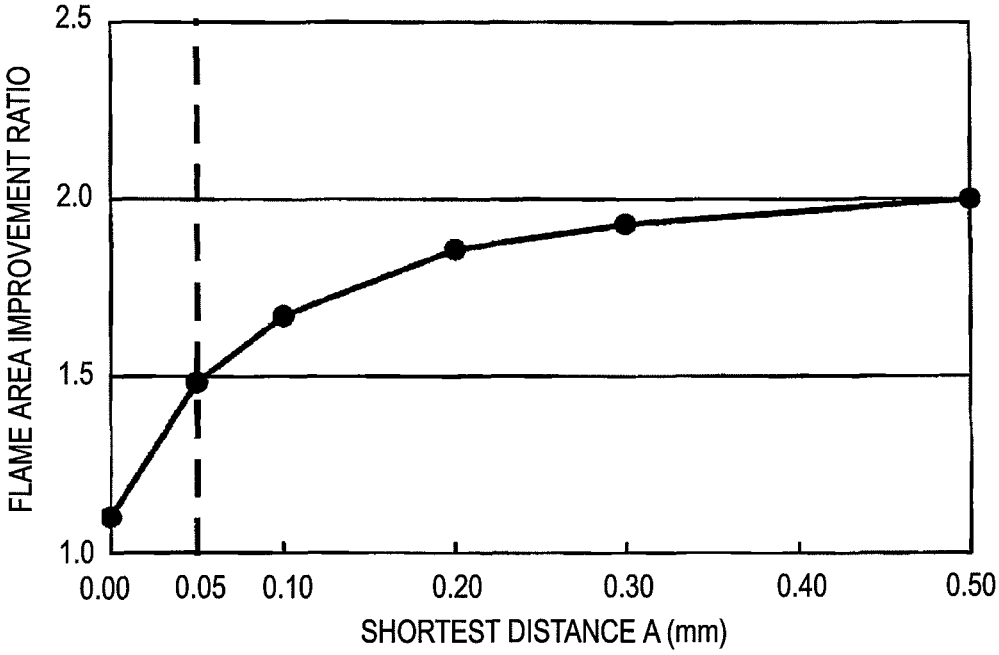
FIG. 20 is a graph showing results of the ignitability evaluation test on samples K wherein a shortest distance A is variously changed.
Figure 21:
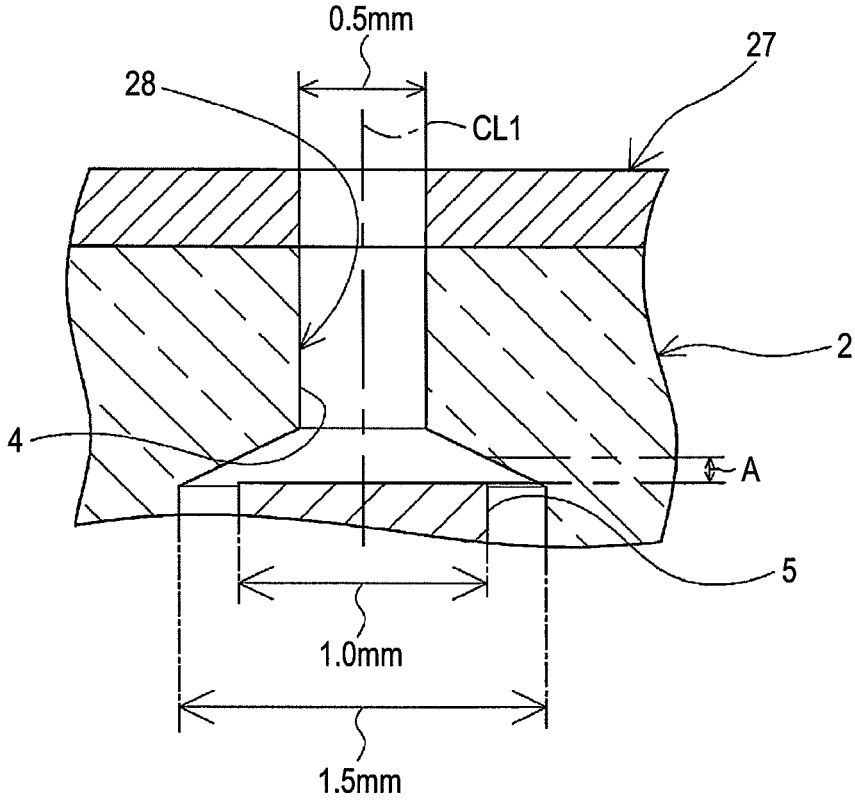
FIG. 21 is a partially enlarged sectional view showing a configuration of a leading end portion of the sample K.

It is revealed, as shown in FIG. 20, that it is possible to effectively improve ignitability by setting the shortest distance A to 0.05 mm or more. It is conceivable that this is because the plasma generation amount increases significantly by plasma being generated in a wide range in the axis direction in a condition in which there is nothing around to suppress a spreading.

According to the test results, it can be said that it is preferable, in order to more reliably improve ignitability, to set the shortest distance A to 0.05 mm or more.

Next, a discharge voltage measurement test is carried out on samples wherein the shortest distance A and the value of "A+(C×0.5)" are variously changed by adjusting the shortest distances A and C. The outline of the discharge voltage measurement test is as follows. That is, after the samples have been mounted in a test chamber, the pressure in the chamber is set to 0.8 MPa, and a discharge voltage (an initial discharge voltage) necessary for a spark discharge is measured in a standard gas atmosphere (an ambient air atmosphere). It can be said that it is preferable that the initial discharge voltage is 20 kV or lower, considering that the discharge voltage increases gradually due to wear of the center electrode, and that the higher the discharge voltage, the more liable a channeling is to occur in the insulator.

Figure 23:
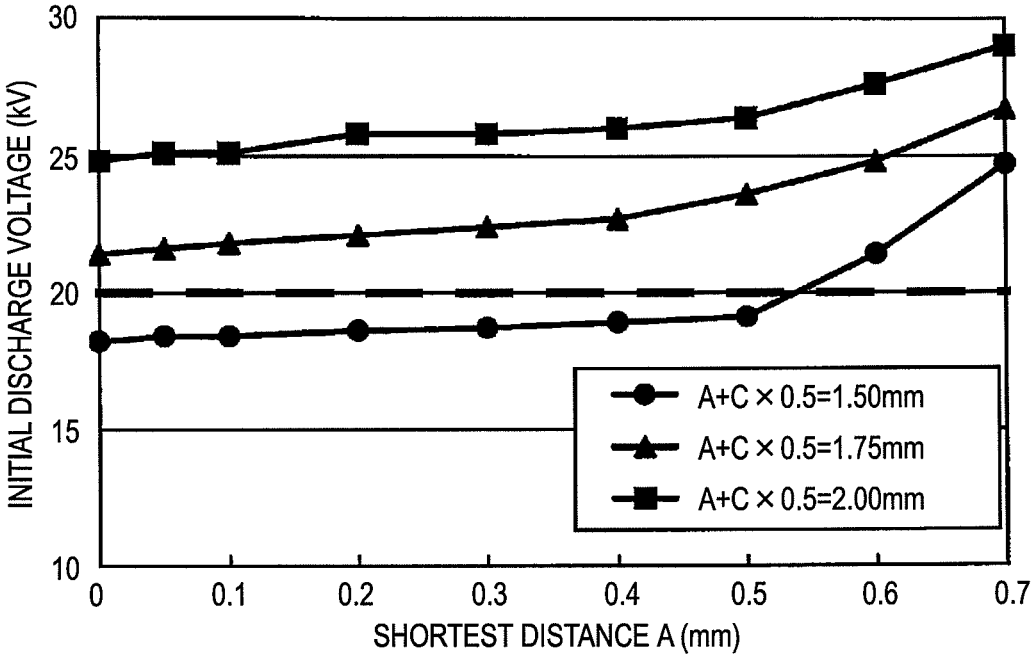
FIG. 23 is a graph showing results of a discharge voltage measurement test on samples wherein the shortest distance A and a shortest distance C are variously changed.

Results of the test are shown in FIG. 23. In FIG. 23, test results of the samples with the value of "A+(C×0.5)" set to 1.50 mm are indicated by circles, test results of the samples with the value of "A+(C×0.5)" set to 1.75 mm are indicated by triangles, and test results of the samples with the value of "A+(C×0.5)" set to 2.00 mm are indicated by squares.

It is confirmed, as shown in FIG. 23, that the samples satisfying $A+(C\times0.5)\leqq1.50$ and $A\leqq0.5$ are such that the initial discharge voltage can be made equal to or lower than 20 kV.

According to the test results, it can be said that it is preferable, from the aspect of preventing a misfire and a progress of a channeling, induced by an increase in discharge voltage, to adopt a configuration such that $A+(C\times0.5)\leqq1.50$ and $A\leqq0.5$ are satisfied.

Figure 24:
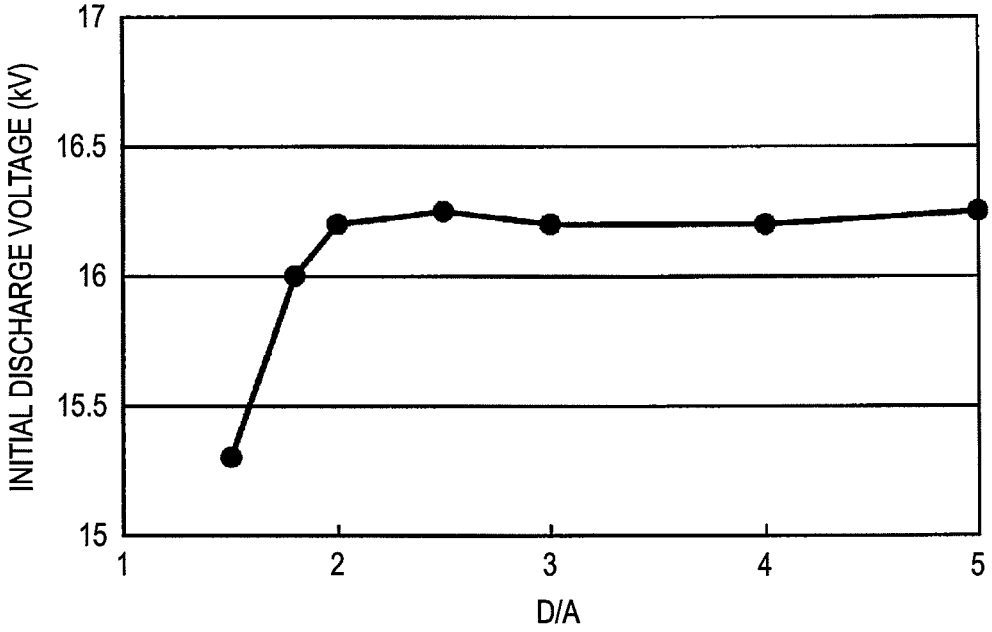
FIG. 24 is a graph showing results of the discharge voltage measurement test on samples wherein D/A is variously changed.

Next, the discharge voltage measurement test is carried out on ignition plug samples wherein the value of D/A is variously changed by changing the shortest distance D after the shortest distance A has been set constant, specifying a range of D/A when it is easier for an aerial discharge passing through the air to occur between the leading end face of the center electrode and the decreasing diameter portion (point "a") than for a creeping discharge to occur along the inner peripheral surface of the insulator between the main body portion of the center electrode and the point "a." That is, in the event that a creeping discharge is occurring between the main body portion and point "a," the initial discharge voltage increases and decreases by changing the shortest distance D, but in the event that an aerial discharge is occurring between the leading end face of the center electrode and the decreasing diameter portion (point "a"), as the shortest distance A is constant, the initial discharge voltage hardly changes even by changing the shortest distance D. Bearing this in mind, a range of D/A when the initial discharge voltage is approximately constant is specified as a condition for it to become easier for an aerial discharge to occur than a creeping discharge. Results of the test are shown in FIG. 24. Each sample is such that the inside diameter of the rear end of the decreasing diameter portion is set to 1.5 mm, the inside diameter of the leading end of the axial hole is set to 0.5 mm, and the angle $\alpha$ of the decreasing diameter portion is set to 20°.

It is found, as shown in FIG. 24, that the initial discharge voltage becomes approximately constant by setting D/A to 2 or more, that is, satisfying $A\times2\leqq D$, and it is thus possible to more reliably cause an aerial discharge between the leading end face of the center electrode and the decreasing diameter portion (point "a") than a creeping discharge between the main body portion and point "a."

According to the test results, it can be said that it is preferable, from the standpoint of more reliably causing an aerial discharge, to adopt a configuration such that $A\times2\leqq D$ is satisfied.

The invention, not being limited to the contents described in the heretofore described embodiment, may be implemented in, for example, the following ways. It goes without saying that other applications and modification examples which are not illustrated below are also possible as a matter of course.

(a) In the heretofore described embodiment, the decreasing diameter portion 4N forms a tapered shape, and the visible outline thereof is made linear on the section including the axis CL1, but a configuration may be adopted such that the visible outline of the decreasing diameter portion 4N forms a curved shape or bent shape. In these cases, the angle α refers to an acute angle among the angles formed by a straight line connecting the leading end and rear end of the decreasing diameter portion 4N and a straight line perpendicular to the axis CL1.

(b) In the heretofore described embodiment, the straight portion 4S is provided on the axial hole 4, but a configuration may be adopted wherein the straight portion 4S is not provided.

(c) In the heretofore described embodiment, a configuration is adopted such that the ground electrode 27 is in contact with the leading end face of the insulator 2, but a slight space between the leading end face of the insulator 2 and the ground electrode 27 may be provided without bringing the two into contact. However, it is preferable, considering the thermal resistance of the ground electrode 27, to bring the ground electrode 27 into contact with the insulator 2.

(d) In the heretofore described embodiment, the cylindrical portion 5C is formed from W, Ir, or the like, but a material configuring the cylindrical portion 5C is not limited to these. Consequently, the cylindrical portion 5C may be formed from, for example, a metallic material the same as that of the main body portion 5M.

(e) In the heretofore described embodiment, the ground electrode 27 is configured from W, Ir, or the like, but a material configuring the ground electrode 27 is not limited to these.

(f) In the heretofore described embodiment, the tool engagement portion 19 is formed in a hexagonal cross-sectional shape, but the shape of the tool engagement portion 19 is not limited to this kind of shape. Consequently, the tool engagement portion 19 may be formed into, for example, a Bi-HEX (variant dodecagonal) shape [ISO22977:2005(E)].

The invention claimed is:

1. A plasma jet ignition plug, comprising:

an elongated insulating body having a first end and a second end;

an elongated axial hole extending along an axis through said insulating body from said first end to said second end;

said elongated axial hole having a decreasing diameter portion near said first end of said insulating body that decrease in diameter in the axial direction toward said first end, a metal shell disposed on the outer periphery of the insulating body, said metal shell having a first end that extends beyond said first end of said insulating body;

a ground electrode fixed to a first end portion of said metal shell adjacent said first end of said insulating body, said ground electrode having a hole therethrough in registry with said cavity portion of said elongated hole;

a center electrode disposed in said axial elongated hole, said center electrode having a first end having an end face of a predetermined diameter, said end face spaced from and facing said decreasing diameter portion of said elongated hole, and a cavity portion formed by being surrounded by the insulating body and the center electrode with the leading end of the axial hole as an opening, such that the following relationship is satisfied:

$$A \leqq B,$$

where "A" is a shortest distance, taken in a direction parallel to said axis, between said end face of said center electrode and said decreasing diameter portion of said elongated hole in said insulating body, and where "B" is a shortest distance, taken perpendicular to said axis, between the outer circumference of said leading edge of the center electrode and a peripheral surface of said elongated hole in said insulating body.

2. The plasma jet ignition plug according to claim 1, wherein $10 \leqq \alpha \leqq 35$, α° being the degree of an acute angle among the angles formed by a visible outline of said decreasing diameter portion and a straight line perpendicular to said axis, on a section including said axis.

3. The plasma jet ignition plug according to claim 1, wherein the cavity portion is formed into a shape wherein the inside diameter decreases gradually toward said first end of said insulating body, or a shape wherein the cavity portion has a region whose inside diameter decreases gradually toward said first end of said insulating body, and has a region whose inside diameter is constant.

4. The plasma jet ignition plug according to claim 1, wherein $V2 \leqq V1 \times 5$ is satisfied;

where $V1(mm^3)$ is the volume of a first cavity portion of the cavity portion bounded by a virtual plane including the leading end face of the center electrode, a virtual plane including the point "a," perpendicular to the axis direction, and the inner peripheral surface of the axial hole , and $V2(mm^3)$ is the volume of a second cavity portion of the cavity portion bounded by the virtual plane including the leading end face of the center electrode, the outer peripheral surface of the center electrode, and the inner peripheral surface of the axial hole and "a" is a point on said decreasing diameter portion which fowls said shortest distance "A".

5. The plasma jet ignition plug according to claim 1, wherein a straight portion, having approximately the same inside diameter, which extends from the leading end of the decreasing diameter portion to the opening of the cavity portion is formed on the axial hole, and a length of the straight portion along the axis is set to 0.3 mm or more.

6. The plasma jet ignition plug according to claim 1, wherein $0.05 \leqq A$ is satisfied, and the first end of the insulating body and the ground electrode are in contact, and $A+(C \times 0.5) \leqq 1.50$ and $A \leqq 0.5$ are satisfied, where C (mm) is a shortest distance along the insulating body inner peripheral surface between the point "a" and the ground electrode.

7. The plasma jet ignition plug according to any one of claims 2 to 6 and claim 1, wherein the center electrode includes:

a main body portion having at its leading end an outside diameter the same as the inside diameter of the axial hole; and a protruding portion, formed adjoining to the main body portion and closer to the axis direction leading end side than the main body portion, the outside diameter of the leading end of which is made smaller than the outside diameter of the leading end of the main body portion, and $A \times 2 \leqq D$ is satisfied where D (mm) is a shortest distance along the insulating body inner peripheral surface between the point "a" and main body portion.

* * * * *